US010858919B2

(12) United States Patent
Anthony et al.

(10) Patent No.: US 10,858,919 B2
(45) Date of Patent: Dec. 8, 2020

(54) QUICK-LOCKING DETONATION ASSEMBLY OF A DOWNHOLE PERFORATING TOOL AND METHOD OF USING SAME

(71) Applicant: GR Energy Services Management, LP, Sugar Land, TX (US)

(72) Inventors: James William Anthony, Missouri City, TX (US); Cameron Michael Bryant, Sugar Land, TX (US); Vadim Akhmadikin, Sugar Land, TX (US)

(73) Assignee: GR Energy Services Management, LP, Sugar Land, TX (US)

( * ) Notice: Subject to any disclaimer, the term of this patent is extended or adjusted under 35 U.S.C. 154(b) by 0 days.

(21) Appl. No.: 16/537,347

(22) Filed: Aug. 9, 2019

(65) Prior Publication Data

US 2020/0048996 A1 Feb. 13, 2020

Related U.S. Application Data

(60) Provisional application No. 62/717,320, filed on Aug. 10, 2018.

(51) Int. Cl.
*E21B 43/117* (2006.01)
*E21B 43/119* (2006.01)
*E21B 43/1185* (2006.01)

(52) U.S. Cl.
CPC ..... *E21B 43/117* (2013.01); *E21B 43/119* (2013.01); *E21B 43/1185* (2013.01)

(58) Field of Classification Search
CPC .... E21B 43/116; E21B 43/117; E21B 43/118; E21B 43/119; E21B 43/1185
See application file for complete search history.

(56) References Cited

U.S. PATENT DOCUMENTS 4,688,640 A * 8/1987 Pritchard, Jr. ..... E21B 29/12 166/297
4,842,093 A 6/1989 Lerche et al.
(Continued)

FOREIGN PATENT DOCUMENTS

EP 601880 A2 6/1994
GB 2405423 A 3/2005
(Continued)

OTHER PUBLICATIONS

DynaEnergetics, DynaStage Perforating Gun System—Improve Wellsite Efficiency with a Truly Modular Design, downloaded from the world wide web, dated at least as early as Aug. 10, 2018, pp. 1-2.
(Continued)

*Primary Examiner* — David Carroll
(74) *Attorney, Agent, or Firm* — JL Salazar

(57) ABSTRACT

A detonation assembly of a perforating unit of a downhole tool is positionable in a wellbore penetrating a subterranean formation, and includes a charge assembly. The detonation assembly includes a detonator housing positionable in the perforating unit and having an uphole and downhole ends; uphole and downhole connections positioned at the uphole and downhole ends, respectively, of the detonator housing; a detonator positioned in the detonation housing; and a trigger positioned in the detonator housing. The trigger includes a detonation switch and a detonator contact. The detonation switch is communicatively coupled, when in use, between a remote actuator and the detonator contact. The detonator contact is positionable in the downhole connection, and has spring-loaded arms extending through openings in the downhole connection to urge electrical contact with the charge assembly whereby an electrical connection is maintained between the detonator and the charge assembly.

20 Claims, 20 Drawing Sheets

(56) References Cited

U.S. PATENT DOCUMENTS 4,886,126 A 12/1989 Yates, Jr.
5,027,708 A * 7/1991 Gonzalez ..... F42D 1/04 102/254
5,042,594 A 8/1991 Gonzalez et al.
5,088,413 A 2/1992 Huber et al.
5,347,929 A * 9/1994 Lerche ..... E21B 43/1185 102/202.14
5,505,134 A 4/1996 Brooks et al.
5,756,926 A * 5/1998 Bonbrake ..... F42D 1/05 102/206
5,971,072 A 10/1999 Huber et al.
6,148,263 A 11/2000 Brooks et al.
6,283,227 B1 9/2001 Lerche et al.
6,383,108 B1 5/2002 Yoo
6,598,682 B2 7/2003 Johnson et al.
6,604,584 B2 8/2003 Lerche et al.
6,752,083 B1 * 6/2004 Lerche ..... E21B 43/1185 102/202.5
6,896,059 B2 5/2005 Brooks et al.
6,938,689 B2 9/2005 Farrant et al.
7,007,756 B2 3/2006 Lerche et al.
7,116,542 B2 10/2006 Lerche et al.
7,336,474 B2 2/2008 Lerche et al.
7,347,278 B2 3/2008 Lerche et al.
7,381,957 B2 6/2008 Medley et al.
7,383,882 B2 6/2008 Lerche et al.
7,461,580 B2 * 12/2008 Bell ..... E21B 43/116 89/1.15
7,485,851 B2 2/2009 Medley et al.
7,485,865 B2 2/2009 Medley et al.
7,505,244 B2 3/2009 Lerche et al.
7,520,323 B2 4/2009 Lerche et al.
7,549,373 B2 6/2009 Brooks et al.
7,690,429 B2 4/2010 Creel et al.
8,091,477 B2 1/2012 Brooks et al.
8,230,788 B2 7/2012 Brooks et al.
8,576,090 B2 11/2013 Lerche et al.
8,689,868 B2 4/2014 Lerche et al.
8,884,778 B2 11/2014 Lerche et al.
9,140,088 B2 9/2015 Brooks
9,371,709 B2 6/2016 Brooks
9,382,783 B2 7/2016 Langford et al.
9,394,767 B2 7/2016 Brooks et al.
9,459,080 B2 10/2016 Collins et al.
9,494,021 B2 11/2016 Parks et al.
9,605,937 B2 3/2017 Eitschberger et al.
9,702,680 B2 7/2017 Parks et al.
9,719,339 B2 8/2017 Richard et al.
9,784,549 B2 10/2017 Eitschberger
9,822,618 B2 11/2017 Eitschberger
9,851,191 B2 12/2017 Lerche et al.
9,951,589 B2 4/2018 Wilson
10,066,921 B2 9/2018 Eitschberger
10,188,990 B2 1/2019 Burmeister et al.
10,309,199 B2 6/2019 Eitschberger
10,309,952 B2 6/2019 Rudnik et al.
10,352,136 B2 7/2019 Goyeneche
10,352,674 B2 7/2019 Eitschberger
10,365,078 B2 7/2019 Eitschberger
10,557,693 B2 2/2020 Lerche et al.
10,648,300 B2 5/2020 Collins et al.
2003/0047358 A1 3/2003 Bonkowski
2004/0216866 A1 11/2004 Barlow et al.
2006/0060355 A1 * 3/2006 Bell ..... E21B 43/116 166/298
2010/0286800 A1 11/2010 Lerche et al.
2011/0090091 A1 4/2011 Lerche et al.
2012/0199352 A1 8/2012 Lanclos et al.
2012/0247769 A1 * 10/2012 Schacherer ..... E21B 43/117 166/297
2013/0042780 A1 * 2/2013 Brooks ..... H02J 7/00 102/202.7
2013/0153205 A1 6/2013 Borgfeld et al.
2013/0220613 A1 8/2013 Brooks et al.
2013/0337635 A1 12/2013 Yamawaku et al.
2014/0151018 A1 6/2014 Lerche et al.
2015/0292306 A1 10/2015 Collins et al.
2015/0292849 A1 10/2015 Lerche et al.
2015/0308795 A1 10/2015 Collins et al.
2015/0322742 A1 11/2015 Brooks
2015/0330192 A1 11/2015 Rogman et al.
2015/0337635 A1 11/2015 Langford et al.
2015/0345916 A1 12/2015 Sokolove et al.
2016/0138394 A1 5/2016 Brooks et al.
2016/0281477 A1 9/2016 Langford et al.
2017/0074078 A1 * 3/2017 Eitschberger ..... F42D 1/043
2017/0119016 A1 5/2017 Cook et al.
2017/0121236 A1 5/2017 Bradley et al.
2017/0122083 A1 5/2017 Wilson
2017/0122086 A1 5/2017 Sheng
2017/0191328 A1 7/2017 Sokolove et al.
2017/0198559 A1 7/2017 Golian et al.
2017/0199015 A1 7/2017 Collins et al.
2017/0199016 A1 7/2017 Collins et al.
2017/0211363 A1 7/2017 Bradley et al.
2017/0275976 A1 9/2017 Collins et al.
2017/0314373 A9 11/2017 Bradley et al.
2017/0370194 A1 12/2017 Lopez et al.
2018/0080298 A1 3/2018 Covalt et al.
2018/0087330 A1 3/2018 Bradley et al.
2018/0094910 A1 4/2018 Ashton et al.
2018/0106121 A1 4/2018 Griffin et al.
2018/0112500 A1 4/2018 Collins et al.
2018/0216445 A1 8/2018 Collins et al.
2018/0347324 A1 12/2018 Langford et al.
2018/0347325 A1 12/2018 Goyeneche
2019/0048693 A1 2/2019 Henke et al.
2019/0085685 A1 3/2019 McBride
2019/0153827 A1 5/2019 Goyeneche
2019/0162056 A1 5/2019 Sansing
2019/0162057 A1 5/2019 Ashton et al.
2019/0195054 A1 6/2019 Bradley et al.
2019/0257158 A1 8/2019 Langford et al.
2019/0368293 A1 12/2019 Covalt et al.
2020/0256168 A1 * 8/2020 Knight ..... E21B 43/119

FOREIGN PATENT DOCUMENTS

WO 2015179787 A1 11/2015
WO 2018112153 A1 6/2018

OTHER PUBLICATIONS

DynaEnergetics, DynaStage Perforating Gun System, downloaded from the world wide web, dated at least as early as Aug. 10, 2018, pp. 1-2.
DynaEnergetics, Gun Assembly, downloaded from the world wide web, dated at least as early as Aug. 10, 2018, p. 1.
Hunting, 2014 Gun System and Accessories Catalog, downloaded from the world wide web, dated 2014, pp. 1-33.
Hunting, H-1 Perforating Gun System—H-1 Gun String—TCP and Gun String—Wireline, downloaded from the world wide web, dated at least as early as Aug. 10, 2018, pp. 1-2.
Hunting, H-1 Perforating Gun System—H-1 Gun String—TCP, downloaded from the world wide web, dated at least as early as Aug. 10, 2018, p. 1.
Hunting, H-1 Perforating Gun System—Titan Division Perforating Systems, downloaded from the world wide web, dated at least as early as Aug. 10, 2018, pp. 1-2.
Hunting, Marketing White Paper: H-1 Perforating Gun System, downloaded from the world wide web, dated Jan. 2017, pp. 1-5.
Schlumberger, Fractal Flex, downloaded from the world wide web, dated at least as early as Aug. 10, 2018, p. 1.

* cited by examiner

QUICK-LOCKING DETONATION ASSEMBLY OF A DOWNHOLE PERFORATING TOOL AND METHOD OF USING SAME

CROSS-REFERENCE TO RELATED APPLICATIONS

The application claims the benefit of U.S. Provisional Application No. 62/717,320, filed on Aug. 10, 2018, the entire contents of which are hereby incorporated by reference herein to the extent not inconsistent with the present disclosure.

BACKGROUND

The present disclosure relates generally to oilfield technology. More specifically, the present disclosure relates to downhole tools with detonators.

Wells are drilled into subsurface formations to reach subsurface targets, such as valuable hydrocarbons. Drilling equipment is positioned at the surface and drilling tools are advanced into the subsurface formation to form wellbores. Once drilled, casing may be inserted into the wellbore and cemented into place to complete the well. Once the well is completed, production tubing may be deployed through the casing and into the wellbore to produce fluid to the surface for capture.

Stimulation techniques have been developed to facilitate the production of fluid from the subterranean formation and into the wellbore. For example, some stimulation tools may be used for injecting and/or pumping fracturing fluids into the subterranean formation to form and/or expand fractures therethrough. Examples of injection tools are provided in U.S. Pat. No. 9,719,339, the entire contents of which is hereby incorporated by reference herein.

In some cases, perforations may be formed along the wall of the wellbore and/or casing for passing the fracturing fluids therethrough. Some stimulation tools may be deployed into the wellbore to create perforations along a wall of the wellbore and into the subterranean formation. Examples of such tools are provided in U.S. Pat. Nos. 6,752,083; 6,752,083; EP0601880; U.S. Pat. Nos. 5,347,929; 5,042,594; 5,088,413; 9,605,937; and US20170314373, the entire contents of which are hereby incorporated by reference herein to the extent not inconsistent with the present disclosure. The perforations may be created by firing charges from the stimulation tool into the wall of the wellbore. See, for example, Patent/Application Nos. US20120199352; US20170211363, US20170275976; and US20180216445, the entire contents of which are hereby incorporated by reference herein to the extent not inconsistent with the present disclosure.

Despite the advancements in stimulation technology, there remains a need for safe and efficient perforating tools. The present disclosure is directed at providing such needs.

SUMMARY

In at least one aspect, the present disclosure relates to a detonation assembly for a perforating unit of a downhole tool positionable in a wellbore penetrating a subterranean formation. The detonation assembly comprises a detonator housing positionable in the perforating unit; a first and second connectors positioned at each end of the detonator housing, the second connector positionable adjacent a charge assembly; a detonator positioned in the detonation housing; and a trigger positioned in the detonator housing.

The trigger comprises a detonation switch and a detonator contact, the detonation switch communicatively coupled between a remote actuator and the detonator contact. The detonator contact is positionable in the second connection, and has spring-loaded arms extending through openings in the second connection to urge electrical contact with the charge assembly whereby an electrical connection is maintained between the detonator and the charge assembly.

The first connector is connectable to another perforating unit of the downhole tool. The first connector comprises a bulkhead and a feedthru. The first connector is electrically connected to the detonation switch. The bulkhead is electrically connected to the detonator switch by a spring-loaded pin. The bulkhead is electrically connectable to the feedthru and the feedthru is electrically connectable to another perforating unit of the downhole tool. The second connector comprises an insert portion insertable into an opening of the detonation housing and an offset portion extending from the insert portion receivably positionable into a mated receptacle in a charge assembly of the perforating unit.

The openings in the second connector are positioned along a flat surface of the offset portion. The flat surface is positionable against a corresponding flat surface of the mated receptacle of the charge assembly. The detonator contact comprises a spring portion and a support portion, the support portion having a curved portion shaped to receive the detonator and a flat portion extending therefrom, the spring portion having spring-loaded arms in the flat portion thereof. The spring-loaded arms have an engagement portion coupled to the flat portion and engageable with a charge assembly of the perforating unit and a tip extending from the engagement portion for connection to the detonation switch. The trigger further comprises a plug and switch contacts. The first connector comprises a bulkhead and a feedthru.

In another aspect, the disclosure relates to a downhole tool positionable in a wellbore penetrating a subterranean formation. The downhole tool comprises a tool housing positionable in the wellbore and at least one perforating unit positionable in the tool housing. Each of the perforating units comprises a perforating housing; a charge assembly positioned in the perforating housing; and a detonation assembly positioned in the perforating housing. The charge assembling has a charge chamber with shaped charges releasably supported therein. The detonation assembly comprises a detonator housing positionable in the perforating unit; a first and second connectors positioned at each end of the detonator housing, the second connector positionable adjacent a charge assembly; a detonator positioned in the detonation housing; and a trigger positioned in the detonator housing. The trigger comprises a detonation switch and a detonator contact, the detonation switch communicatively coupled between a remote actuator and the detonator contact. The detonator contact is positionable in the second connection, and has spring-loaded arms extending through openings in the second connection to urge electrical contact with the charge assembly whereby an electrical connection is maintained between the detonator and the charge assembly.

The charge assembly comprises a charge tube, a receiver, and a charge feedthru. The charge feedthru is electrically connectable with the detonation assembly. The charge feedthru comprising a locking cap, plunger, retainer, and end plate. The detonator contact has an asymmetric end positionable in the receiver. The receiver comprises a detonation link defining a detonator receptacle in the receiver. The detonator receptacle shaped to matingly receive (i.e. mate with) the asymmetric end and the detonation link having a contact surface engageable with the electrical contacts. The downhole tool further comprises a retainer, a support sub, and/or a conveyance connector.

Finally, in another aspect, the disclosure relates to a method of assembling a downhole tool. The method comprises assembling a detonation assembly; assembling a charge assembly; providing a tool housing; positioning the charge assembly in the tool housing; positioning the detonation assembly in the tool housing; and electrically connecting the detonation assembly with the charge assembly.

In another aspect, the detonation assembly is for a perforating unit of a downhole tool positionable in a wellbore penetrating a subterranean formation, and the perforating unit also including a charge assembly. The detonation assembly comprises a detonator housing positionable within the perforating unit, the detonator housing having an uphole end and a downhole end; an uphole connection and a downhole connection positioned at the uphole end and the downhole end, respectively, of the detonator housing, the downhole connection positionable adjacent the charge assembly; a detonator positioned in the detonator housing; and a trigger positioned in the detonator housing. The trigger comprises a detonation switch and a detonator contact, the detonation switch communicatively coupled, when in use, between a remote actuator and the detonator contact, the detonator contact positionable in the downhole connection, the detonator contact having spring-loaded arms extending through openings in the downhole connection to urge electrical contact with the charge assembly whereby an electrical connection is maintained between the detonator and the charge assembly.

The uphole connector is connectable to a second perforating unit of the downhole tool, the uphole connector comprises a bulkhead and a feedthrough, and the uphole connector is electrically connected to the detonation switch. The bulkhead is electrically connected to the detonator switch by a spring-loaded pin. The bulkhead is electrically connectable to the feedthru and the feedthru is electrically connectable to a third perforating unit of the downhole tool. The downhole connection comprises an insert portion insertable into an opening of the detonation housing and an asymmetrical portion extending from the insert portion, the asymmetrical portion receivably positionable into a mated receptacle in the charge assembly. The openings are positioned along a flat surface of the asymmetrical portion, the flat surface positionable against a corresponding flat surface of the mated receptacle of the charge assembly. The detonator contact comprises a spring portion and a support portion, the spring and support portions each having a curved portion shaped to receive the detonator and a flat portion extending therefrom, the spring portion having the spring-loaded arms in the flat portion thereof. The flat portions of each of the spring and support portions are positionable adjacent to each other, the spring-loaded arms having an engagement portion coupled to the flat portion and engageable with the flat surface of the charge assembly and a support tip extending from the engagement portion for engagement with the flat portion of the support portion whereby the engagement portion is urged against the flat surface of the charge assembly. The trigger further comprises a plug and contacts electrically connectable between the detonator switch and the detonator contact. The uphole connector comprises a bulkhead and a feedthru, the bulkhead having a slotted lock, the feedthru having a mated pin engageable with the slotted lock.

In another aspect, the disclosure relates to a downhole tool positionable in a wellbore penetrating a subterranean formation. The downhole tool comprises a tool housing positionable in the wellbore; and at least one perforating unit positionable in the housing. Each of the at least one perforating units comprises a perforating housing; a charge assembly positioned in the perforating housing, the charge assembly having a charge chamber with shaped charges releasably supported in the charge chamber; and a detonation assembly positioned in the perforating housing. The detonation assembly comprises a detonator housing having an uphole end and a downhole end and positionable in the perforating housing; an uphole connection and a downhole connection positioned at the uphole end and the downhole end, respectively, of the detonator housing, the downhole connection positionable adjacent the charge assembly; a detonator positioned in the detonator housing; and a trigger positioned in the detonator housing. The trigger comprising a detonation switch and a detonator contact, the detonation switch communicatively coupled, when in use, between a remote actuator and the detonator contact, the detonator contact positionable in the downhole connection, the detonator contact having spring-loaded arms extending through openings in the downhole connection to urge electrical contact with the charge assembly whereby an electrical connection is maintained between the detonator and the charge assembly.

The charge assembly comprises a charge tube, a zipfire receive, and a charge feedthrough. The charge feedthru is electrically connectable with the detonator feedthru, the charge feedthru comprising a locking cap, plunger, retainer, and end plate. The detonator contact has an asymmetric end positionable in the zipfire receiver, the zipfire receiver comprising a detonation link defining a detonator receptacle in the zipfire receiver, the detonator receptacle shaped to matingly receive the asymmetric end and the detonation link having a contact surface engageable with the electrical contacts. The downhole tool of claim 11, further comprising a retainer, a support sub, and/or a conveyance connector.

Finally, in another aspect, the disclosure relates to a method of assembling a downhole tool. The method comprises assembling a detonation assembly as in claim 1; assembling a charge assembly; providing a tool housing; positioning the charge assembly in the tool housing; positioning the detonation assembly in the tool housing; and electrically connecting the detonation assembly with the charge assembly.

The method further comprises positioning a second perforating unit in the tool housing and connecting the uphole connector to the second perforating unit. The uphole connector comprises a bulkhead and a feedthrough, and the method further comprises electrically connecting the uphole connector to the detonation switch.

This Summary is not intended to be limiting and should be read in light of the entire disclosure including text, claims and figures herein.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

The description that follows includes exemplary apparatus, methods, techniques, and/or instruction sequences that embody techniques of the present subject matter. However, it is understood that the described embodiments may be practiced without these specific details.

This disclosure relates to a denotator assembly of a downhole perforating tool positionable in a wellbore at a wellsite. The perforating tool is provided with one or more perforating units, each perforating unit including a housing with charge assembly and detonation assembly secured therein. The perforating units have quick-locking features to facilitate assembly and operation of the perforating tool and its detonator.

The charge and detonation assemblies are provided with quick-locking features for quick, one-way, redundant, and secure assembly and operation. For example, the charge and detonation assemblies may have one-way pin and guide (e.g., slot) locking mechanisms (with or without additional locks) for securing the components in place. In another example, the charge and detonation assemblies may have components shaped for one-way insertion into and/or connection with adjacent components to assure proper positioning and fit of the components.

In yet another example, the charge and detonation assemblies may have locking contacts with push-in place dual spring activation and redundant contact surfaces for maintaining a communication connection with the detonator and/or between the detonation assembly and the charge assembly for the passage of signals therebetween. The communication links and/or connections may be or include various communication components, such as wires, cables, plates, contacts, switches, plugs, and/or other features, capable of passing electrical, power, and/or other signals.

The present disclosure seeks to provide features capable of providing one or more of the following, among others: means for signal communication (e.g., electrical connection), push in place assembly, spring loaded contact, redundant components and/or contacts, mechanisms to assure good electrical contact, reliable communication and/or operation, pre-assembly and/or offsite assembly capabilities, snap on electrical connections, quick connections and/or locks, no requirement for soldering and/or crimping contacts, reliability, time savings, low maintenance costs, etc.

Figure 1:
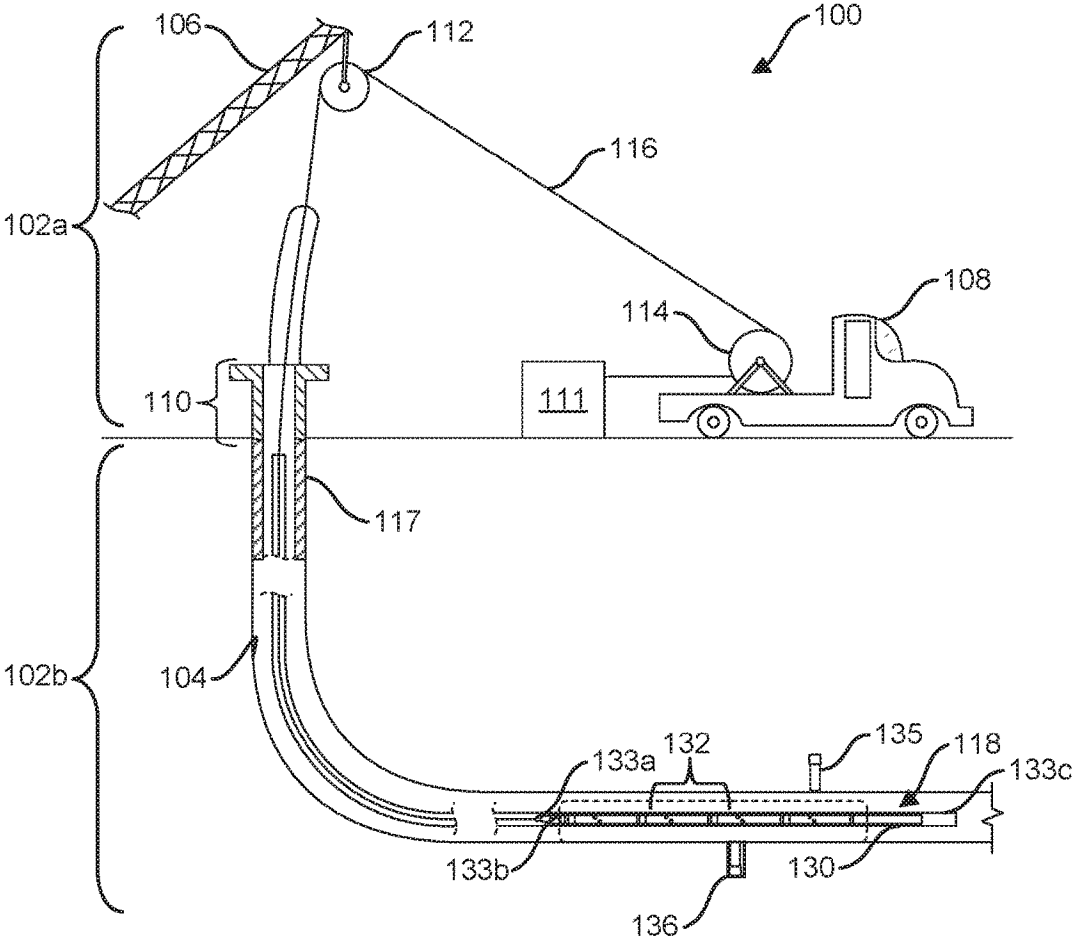
FIG. 1 is a schematic diagram depicting a wellsite with surface and downhole equipment, the downhole equipment comprising a downhole perforating tool having a quick-locking detonation assembly.

FIG. 1 is a schematic diagram depicting a wellsite 100 with surface equipment 102*a* and downhole equipment 102*b* positioned in a wellbore 104. The wellsite 100 may be any wellsite positioned about a subterranean formation, such as an unconventional formation (e.g., shale) with a reservoir (e.g., oil, gas, water) therein. The surface equipment 102*a* includes a crane 106, a truck 108, a wellhead assembly 110, and a surface unit 111. The crane 106 supports a pulley 112. The truck 108 supports a spool 114. A conveyance (e.g., wireline) 116 extends from the spool 114 over the pulley 112 and into the wellbore 104. The surface unit 111 is coupled to the conveyance 116 for communication therewith.

Figure 2:
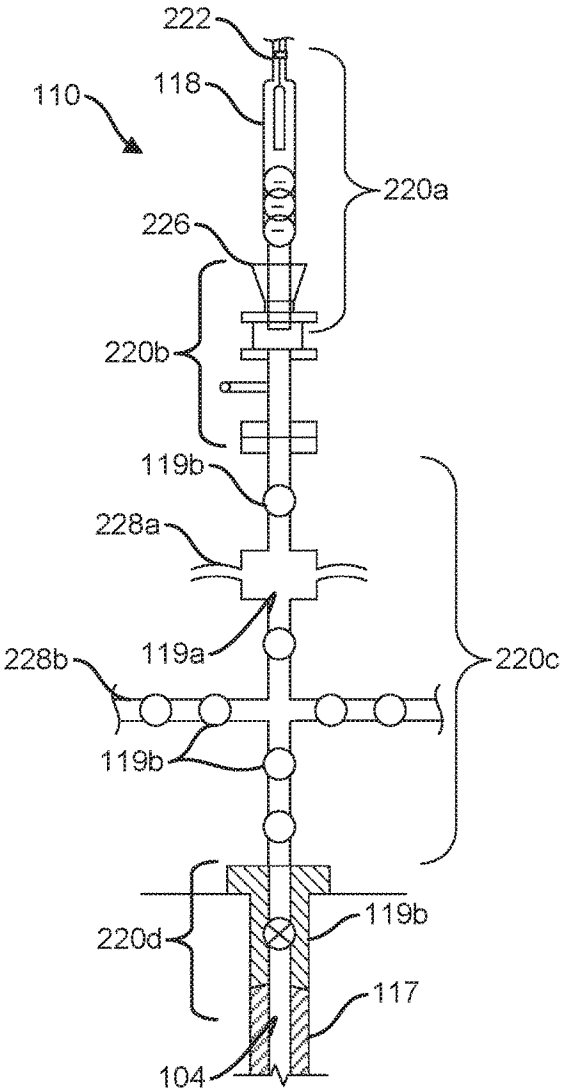
FIG. 2 is a schematic diagram depicting the surface equipment of FIG. 1 in greater detail.

The wellhead assembly 110 is disposed at a surface opening of the wellbore 104. An example wellhead assembly 110 is shown in FIG. 2. The wellhead assembly 110 includes a wireline lubricator 220*a*, a hydraulic disconnect 220*b*, a frac tree 220*c*, and a wellhead 220*d*. Portions of the wellhead assembly 110 are connectable to pressure control equipment (not shown) for the passage of fluids and/or to control pressures at the wellsite 100. A passage 119*a* extends through the wireline lubricator 220*a*, the hydraulic disconnect 220*b*, the frac tree 220*c*, and the wellhead 220*d* for fluid communication with the wellbore 104. Valves 119*b* are positioned about the wellhead assembly 110 to controllably restrict passage of fluid through portions thereof.

The wireline lubricator 220*a* is positioned at an upper end of the wellhead assembly 110 and is receivably supported in the hydraulic disconnect 220*b*. Seals 222 are positioned at an upper end of the wireline lubricator 220*a* for fluid isolation within the wellhead assembly 110. The wireline lubricator 220*a* may be detached from the wellhead assembly 110 and carried by the crane 106 for placement in the hydraulic disconnect 220*b*.

The hydraulic disconnect 220*b* includes a tulip 226 at an upper end to receive the wireline lubricator 220*a*. The hydraulic disconnect 220*b* is supported between the wireline lubricator 220*a* and the frac tree 220*c*. Once the wireline lubricator 220*a* is positioned in the tulip 226, the valves 119*b* on the hydraulic disconnect 220*b* may be opened to pass fluid therethrough or closed to isolate the passage therein. A lower end of hydraulic disconnect 220*b* is connectable to an upper end of the frac tree 220*c*. The frac tree 220*c* includes a goat head 228*a* and a cross member 228*b*. A lower end of the frac tree 220*c* is connectable to the wellhead 220*d*.

Referring back to FIG. 1, the downhole equipment 102*b* includes a casing 117 positioned in the wellbore 104 and a downhole tool 118 supported in the wellbore 104 by the conveyance 116. The casing 117 is a tubular member that lines the wellbore 104 and is connected to the wellhead

220*d*. Note that in some embodiments the casing 117 may be omitted (e.g., for openhole applications), or the casing 117 may be installed in only a portion of the wellbore 104.

Figure 3:
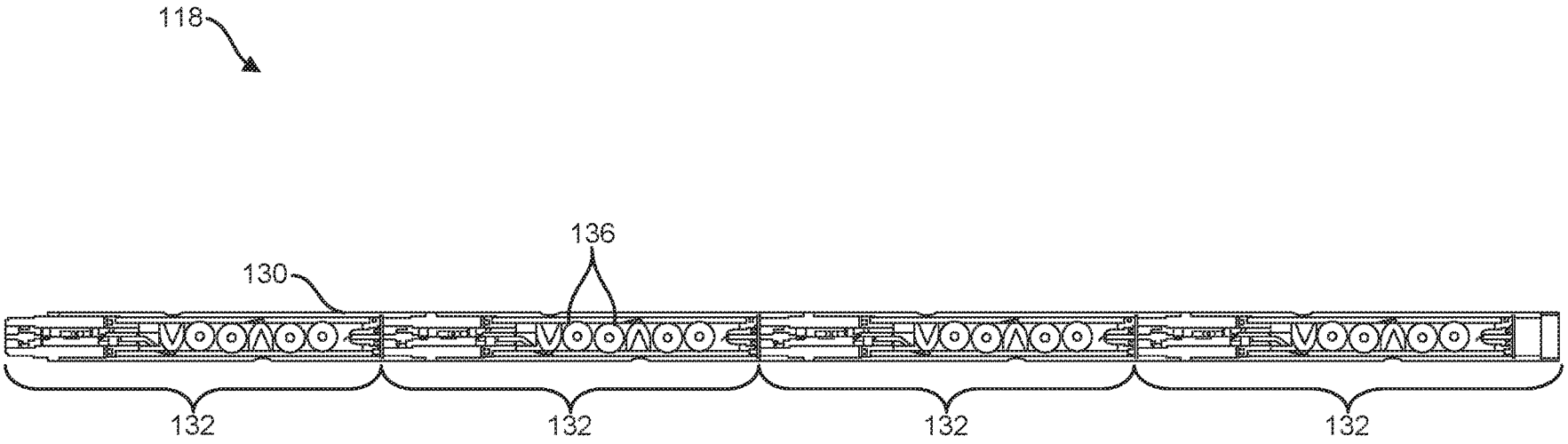
FIG. 3 is a longitudinal, cross-sectional view of a portion of the downhole perforating tool comprising a plurality of perforating units.

Referring to FIGS. 1 and 3, the downhole tool 118 comprises a housing 130 with a series of perforating units 132 therein. The housing 130 is a tubular member positionable in the wellbore 104 by the conveyance 116 and shaped to receivably support each of the perforating units 132 therein. The perforating units 132 are connected together end to end in series. Threaded connections may be provided at each end of the perforating units 132 for connecting one or more perforating units 132 together. In the illustrated embodiment, there are four perforating units 132, but other embodiments may employ different numbers of perforating units 132. Some embodiments may use as few as one perforating unit 132.

The perforating units 132 are positioned in the housing 130 and carry shaped charges 136. The shaped charges 136 are explosive components that form a focused radially-oriented jet when activated. This jet makes a perforation 135 that extends through the wall of the wellbore 104 (and the casing 117 and cement if present) and into the subterranean formation surrounding the wellbore 104. The shaped charges 136 may be configured to create the perforations 135 for passage of fracturing (or injection) fluid into the formation for hydraulic fracturing therein.

The perforating units 132 may be communicatively connected to the surface unit 111 by the wireline 116 and/or by other means (e.g., wireline, electromagnetic, sonar, or other communication means). The perforating units 132 may be independently operated, or communicatively linked together for integrated operation therebetween. A communication link (e.g., wire or cable, not separately shown) may extend from the wireline 116 through the housing 130 and/or the perforating units 132. The perforating units 132 may be connected by the communication link for communication therebetween and/or for communication with the other components of the downhole tool 118.

The downhole tool 118 may be provided with various components, such as a conveyance connector 133*a*, a collar locator ("CCL") 133*b*, and a plug-setting tool 133*c*, all shown in FIG. 1. The conveyance connector 133*a* may be provided at a first end of the downhole tool 118 for connection to the wireline 116. The plug setting tool 133*c* may secure the downhole tool 118 at specified depths along the wellbore 104.

The downhole tool 118 and/or one or more of the perforating units 132 may be coupled via a wired or wireless connection to the surface unit 111 as described above for operation therewith. The perforating unit(s) 132 may be activated by the surface unit 111 to selectively fire one or more of the shaped charges 136 to form the perforations 135 as schematically depicted in FIG. 1.

During operation, the downhole tool 118 may be carried in the wireline lubricator 220*a* via the wireline 116 to the wellsite 100 with the crane 106. Once the wireline lubricator 220*a* is secured in the tulip 226, the valve 119*b* of the hydraulic disconnect 220*b* may be opened to pump fluid to push the downhole tool 118 through the wellhead assembly 110 and into the wellbore 104. Fluid beneath the downhole tool 118 may be pumped back to the surface or exited out the wellbore 104 via pre-existing perforations (not shown) in the casing 118 to avoid the need for the fluid to return to the surface.

The CCL 133*b* may communicate an electrical signal up the wireline 116 to the surface unit 111 as it passes between adjacent segments of the casing 117. A position of the downhole tool 118 may be determined by counting these signals as the perforating system is pumped down the wellbore and by knowing the length of each segment of casing 117. However, other embodiments may use other techniques for determining the location of the CCL 133*b* in the wellbore 104.

When the bottom (i.e. downhole end) of the downhole tool 118 is at a desired position above the perforations 135 that are closest to the surface, pumping may be terminated. A coded communication signal may be sent down the wireline 116 to activate the plug-setting tool 133*c* to lock the downhole tool 118 in position. The signal may also be used to activate a switch in the perforating unit 132 to activate the perforating unit 132 to fire as is described further herein. Once fired, the plug-setting tool 133*c* may be activated to disconnect the downhole tool 118 and move the perforating tool 118 to another location or out of the wellbore 104.

Figure 4A:
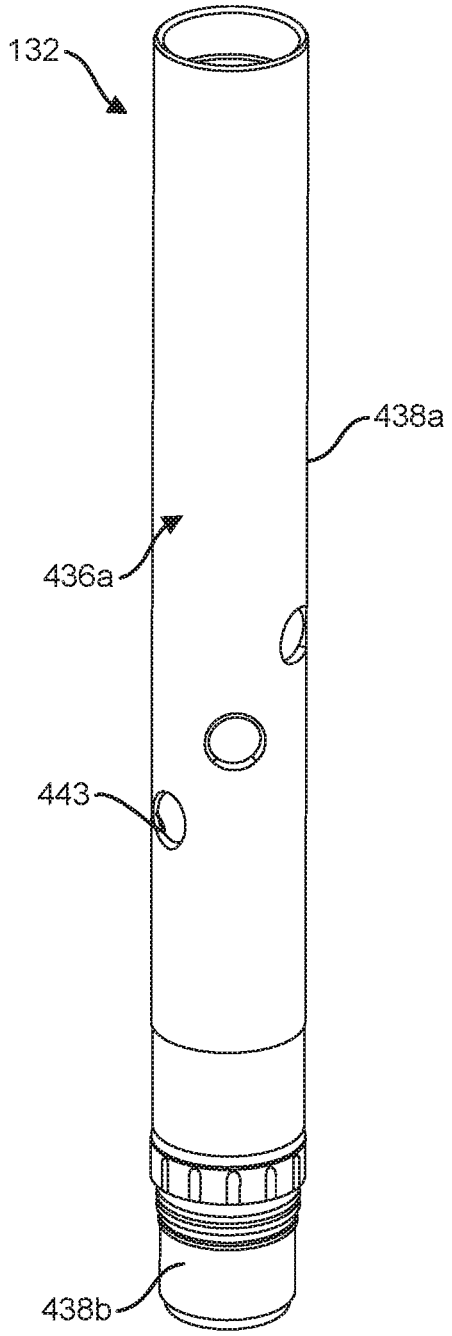
FIGS. 4A and 4B are perspective and longitudinal, cross-sectional views of one of the perforating units.
Figure 4B:
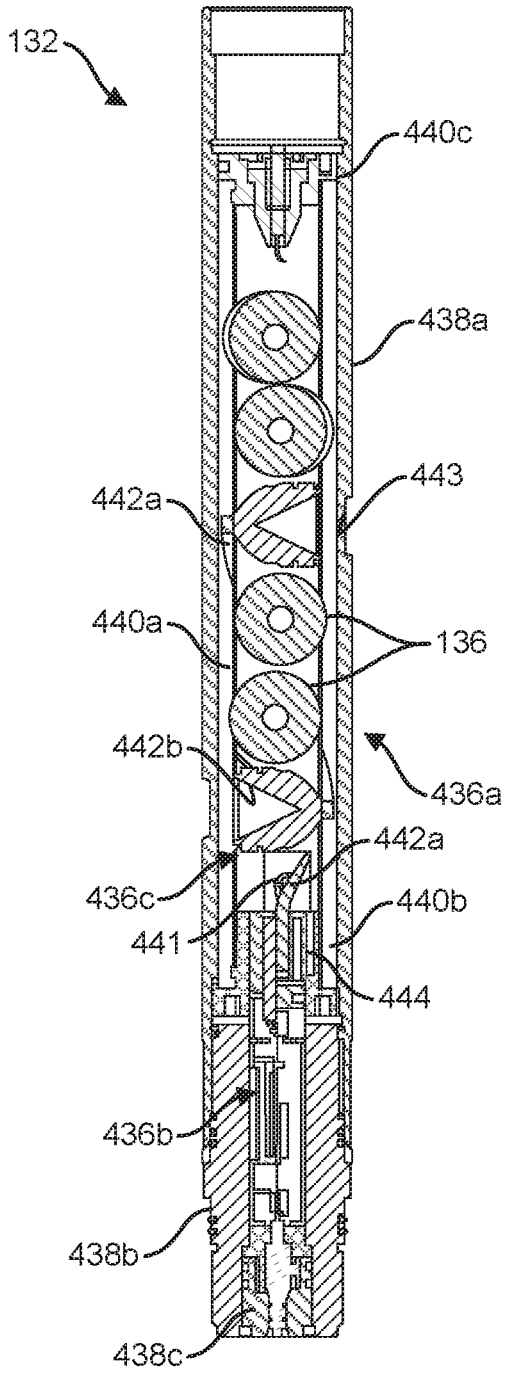
Figure 5:
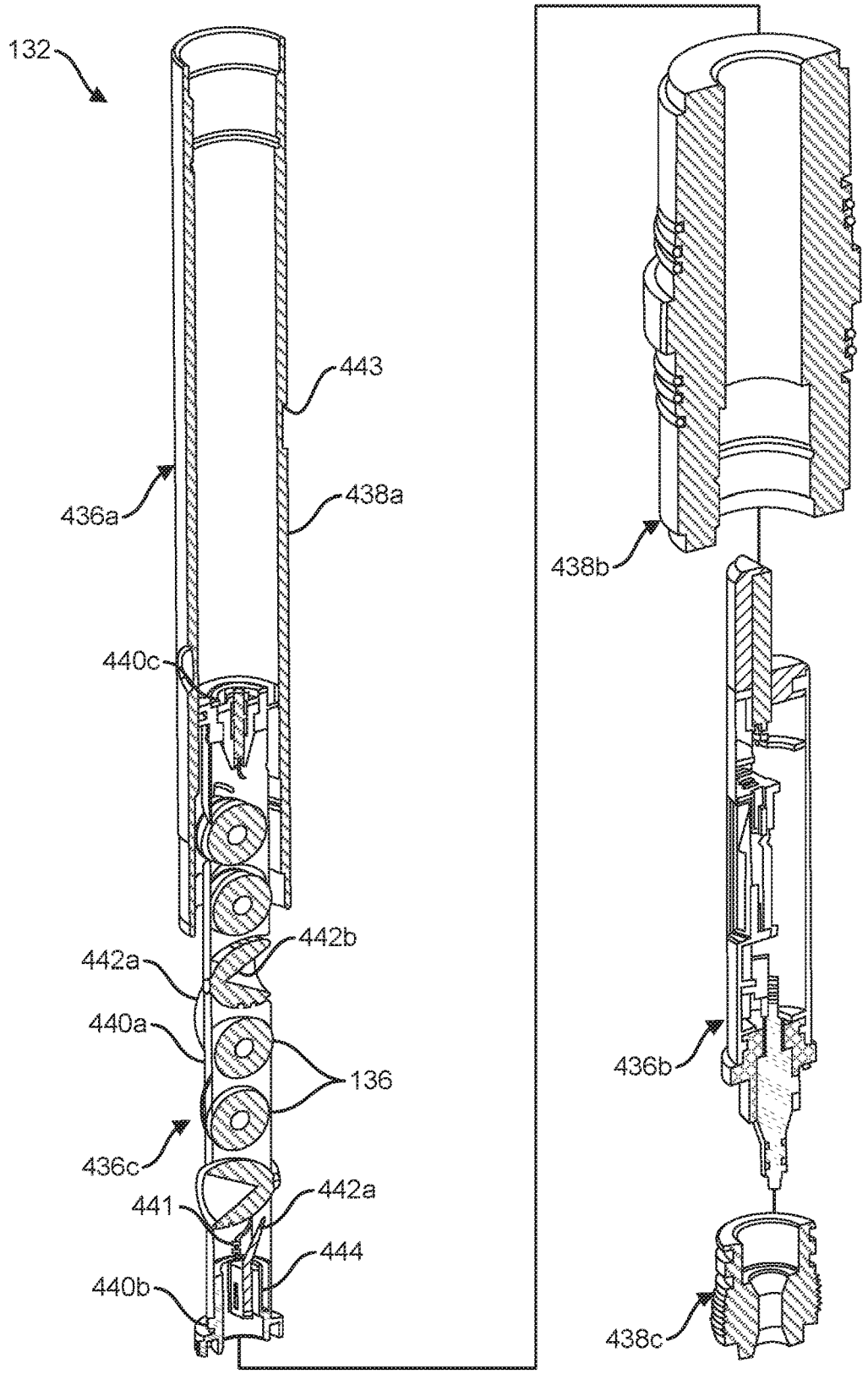
FIG. 5 is a cross-sectional, exploded view of the perforating unit.

FIGS. 4A-5 show one of the perforating units 132 in greater detail. FIGS. 4A and 4B show perspective and longitudinal, cross-sectional views of the perforating unit 132. FIG. 5 shows a cross-sectional, exploded view of the perforating unit 132. As shown in these views, the perforating unit 132 includes a perforating housing 436*a*, a detonation assembly 436*b*, and a charge assembly 436*c*.

Referring collectively to FIGS. 4A-5, the perforating housing 436*a* includes an outer tube 438*a*, a support sub 438*b*, and a retainer 438*c*. The outer tube 438*a* is a tubular member slidingly receivable in the housing 130 (shown in FIG. 3). The outer tube 438*a* is shaped to receive the charge assembly 436*c* therein. The outer tube 438*a* has an end shaped to receive the support sub 438*b* and an opposite end shaped for connection to another perforating unit 132. The support sub 438*b* has an end insertable into the opposite end of the outer tube 438*a* and threadedly connected therewith. The support sub 438*b* also has another end extending from the outer tube 438*a* for connection to an adjacent perforating unit 132.

The support sub 438*b* is a tubular member shaped to support the retainer 438*c* and the detonation assembly 436*b*. The retainer 438*c* is positioned in an end of the support sub 438*b* to secure the detonation assembly 436*b* in the perforator housing 436*a*. The detonation assembly 436*b* is positioned in the support sub 438*b* and extends from the retainer 438*c* a distance into the charge assembly 436*c* for operative connection therewith as is described further herein.

Each of the perforating units 132 is provided with a communication link (e.g., wire) 441 extending therethrough for activating the detonation assembly 436*b* to fire the shaped charges 136. The communication link 441 may be a wire extending from the detonation assembly 436*b* through the charge tube 440*a* and to the charge feedthru 440*c*. The perforating units 132, where multiple perforating units 132 are employed, are connected in series with the communication link 441 coupled therebetween for selective activation of one or more of the perforating units 132. The communication link 441 of each perforating unit 132 may be coupled to an adjacent perforating unit 132 at each end of the perforation unit via the detonation assembly 436*b* at one end and the charge feedthru 440*c* at the other end for communication therewith. This connection may be repeated between the perforating units 132 to provide a series of connections for communication across the perforating units 132.

Figure 6A:
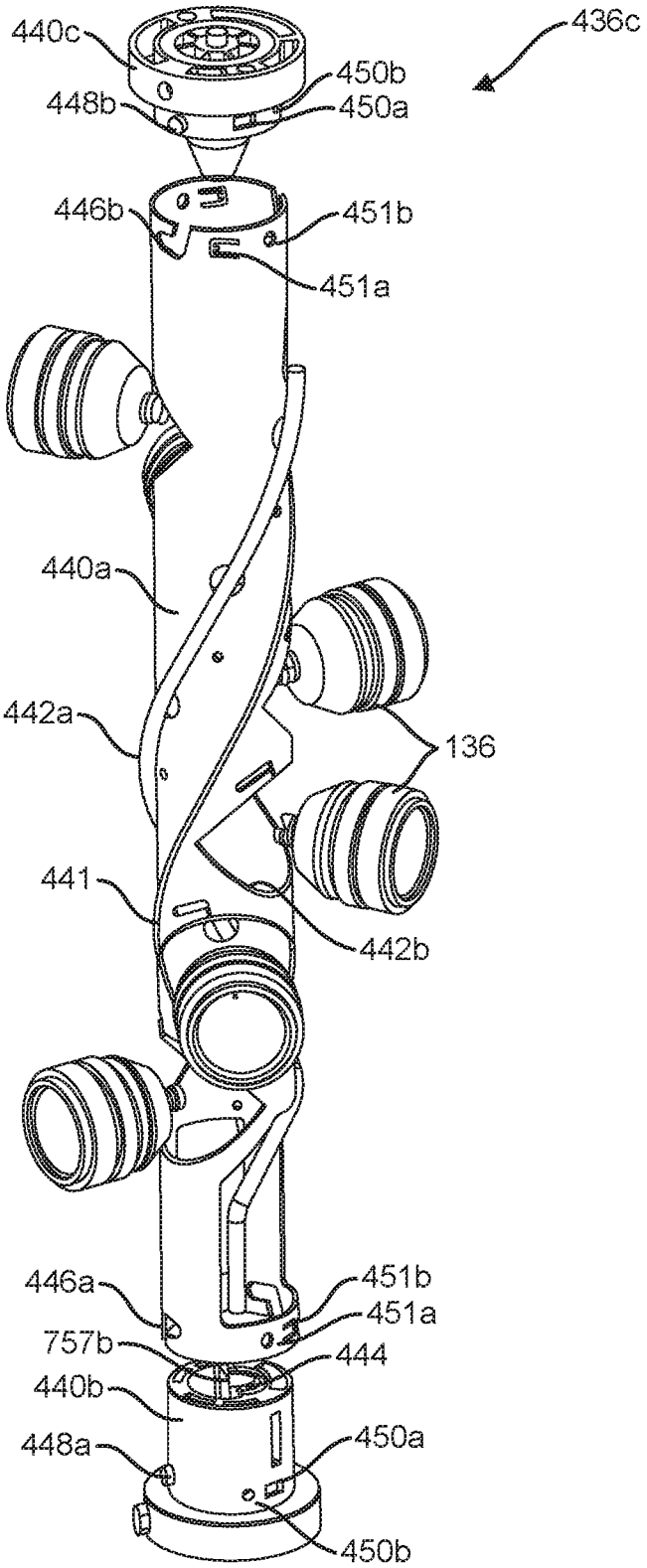
FIGS. 6A and 6B are exploded and partial cross-sectional views, respectively, of a charge assembly of the perforating unit.
Figure 6B:
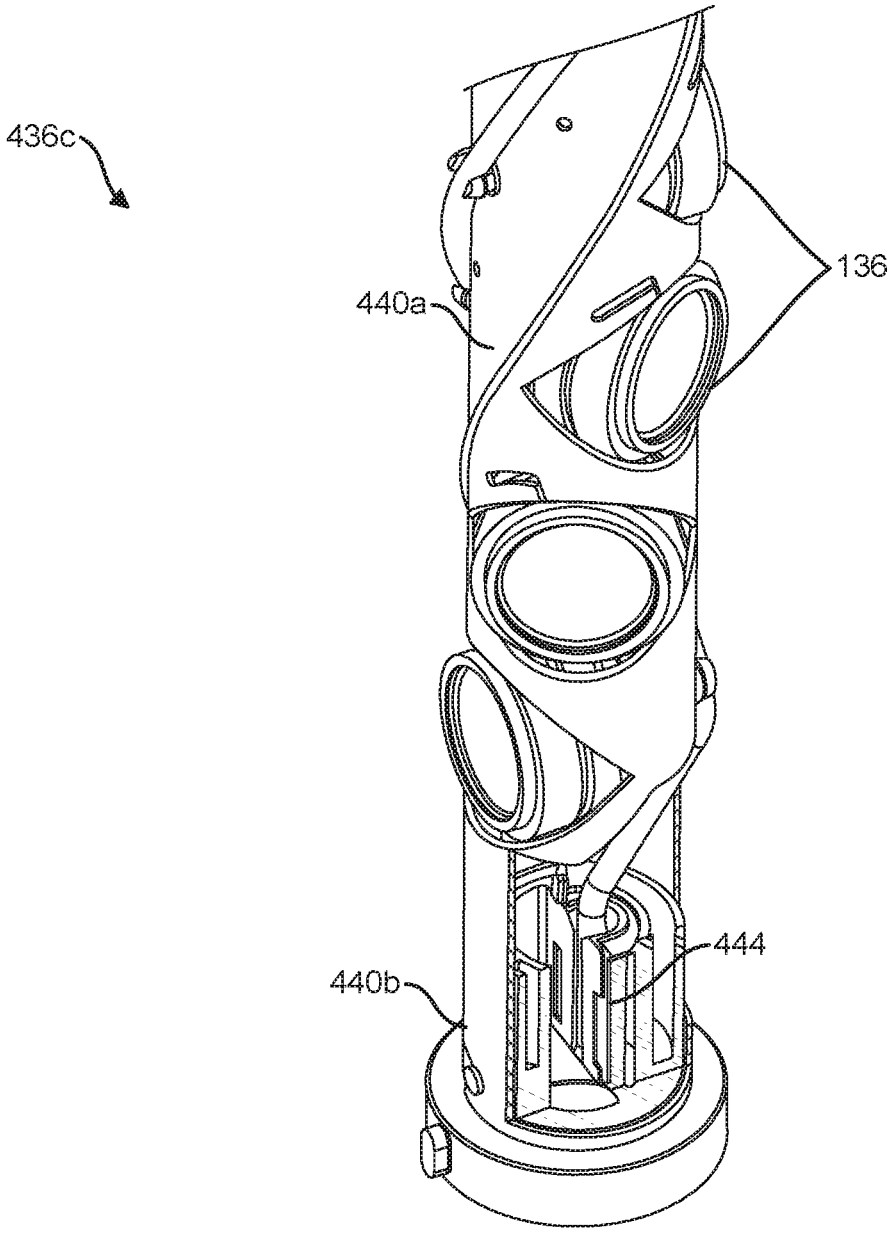
Figure 7:
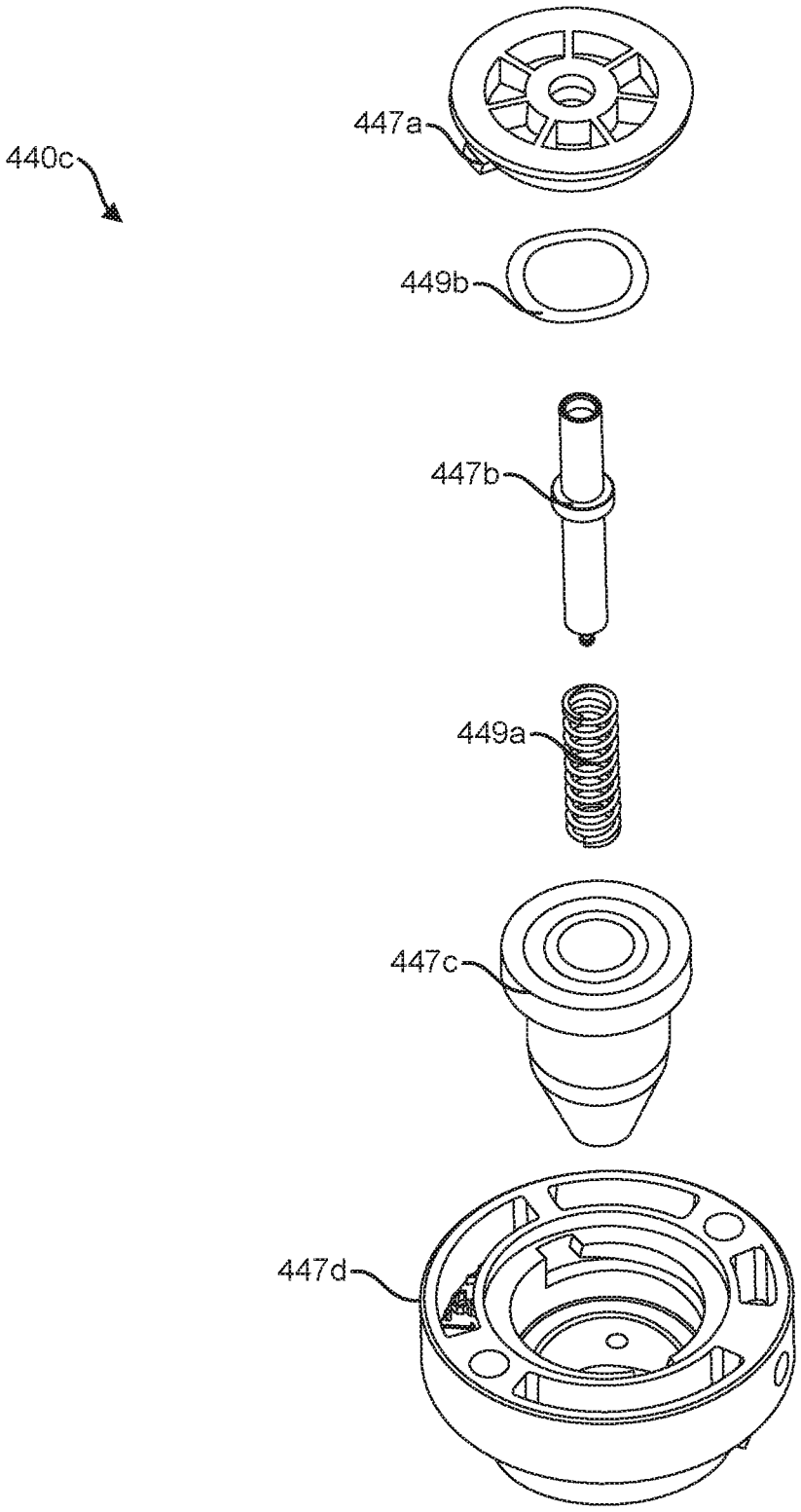
FIG. 7 is an exploded view of a charge feedthru of the charge assembly.
Figure 8A:
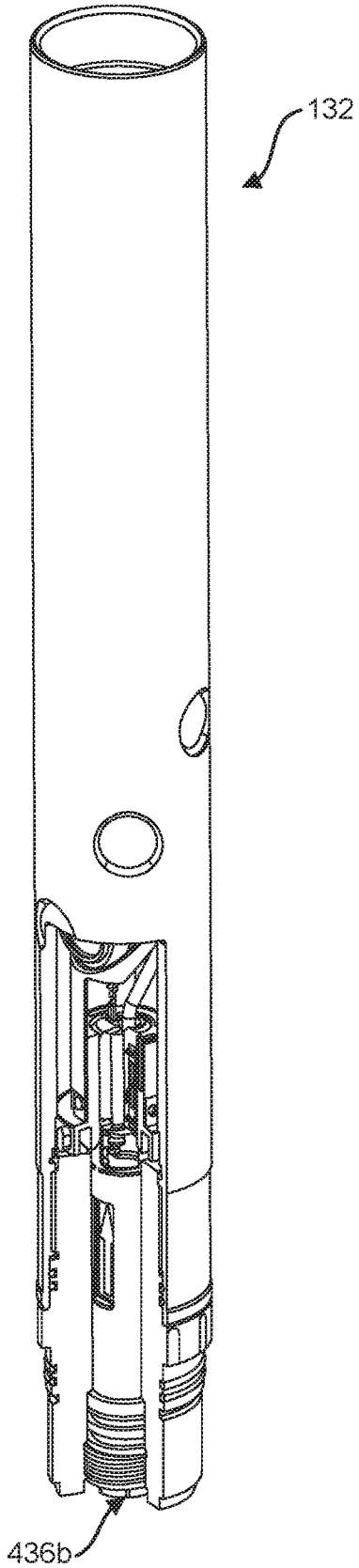
FIGS. 8A-8C are partial cross-sectional views of the perforating unit depicting a detonation assembly therein.
Figure 8B:
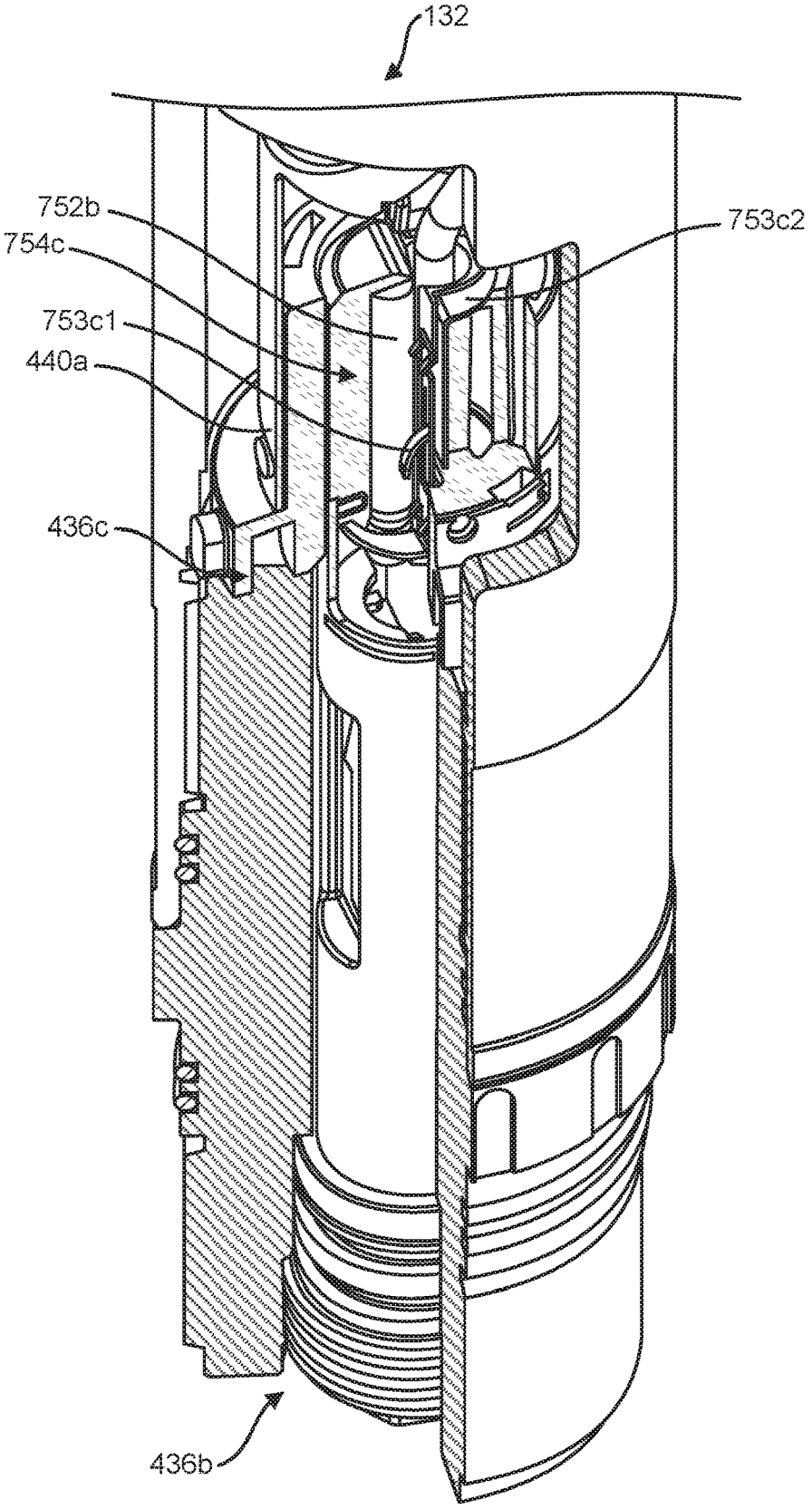
Figure 8C:
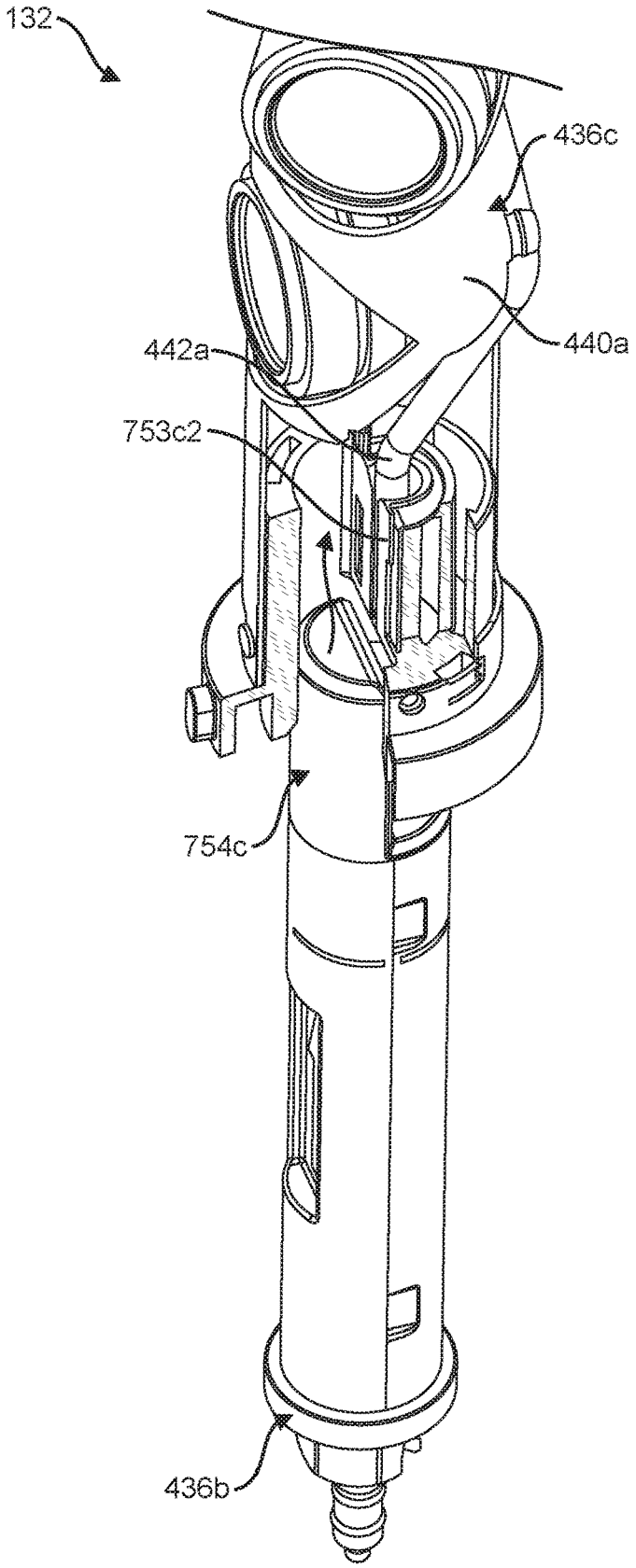
Figure 9:
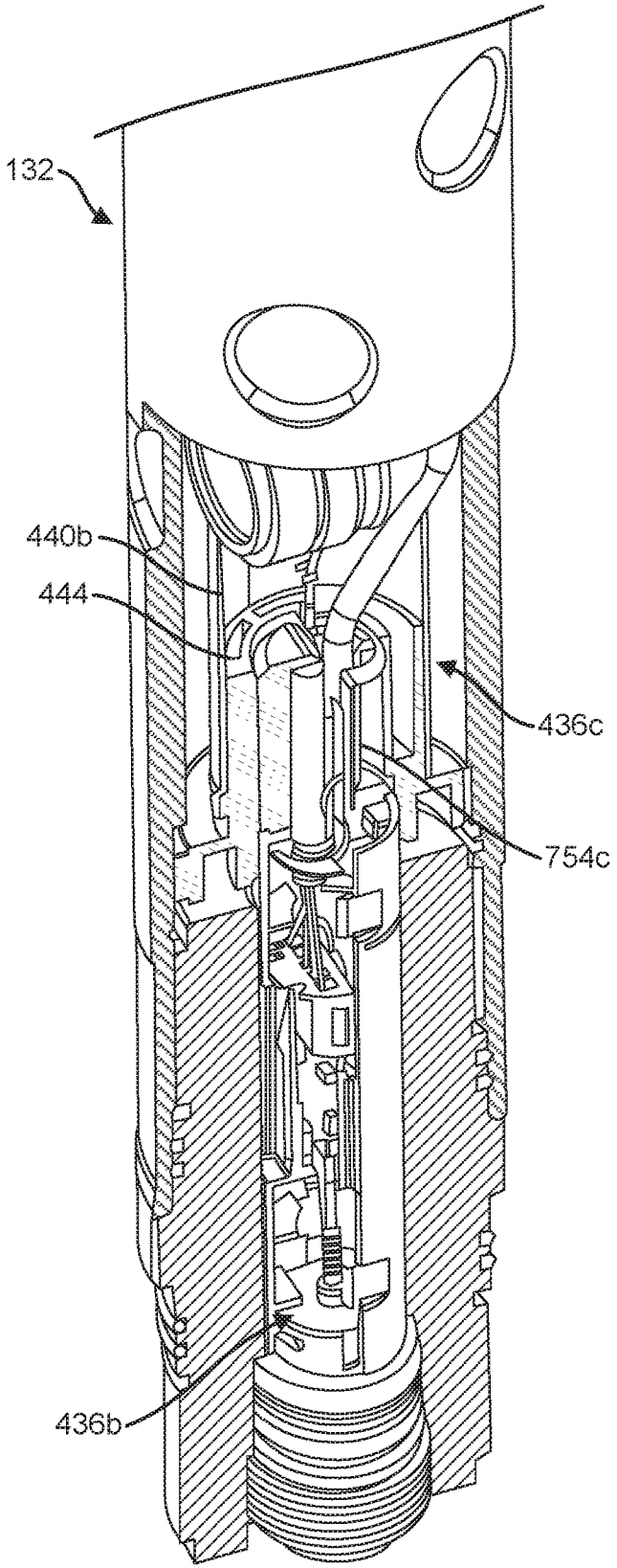
FIG. 9 is another partial cross-sectional view of a portion of the perforating unit and the detonation assembly therein.

Referring to FIGS. 6A-6B, and 7 (as well as FIGS. 4B-5), features of the charge assembly 436*c* are shown. The charge assembly 436*c* includes a charge tube 440*a*, a receiver 440*b* at one end of the charge tube 440*a*, and a charge feedthru

440*c* at an opposite end of the charge tube 440*a*. The charge tube 440*a* is slidingly receivable in the outer tube 438*a*. The charge tube 440*a* has the shaped charges 136 supported therein. The charge tube 440*a* also has a charge cable 442*a* and ports 442*b*.

The receiver 440*b* may be a flange shaped member receivable about an end of the charge tube 440*a* for connection to the support sub 438*b*. The receiver 440*b* may also be provided with a charge receptacle 444 shaped to receive the end of the detonation assembly 436*b* for connection therewith. The charge cable (or detonator cord) 442*a* is a fuse connected to the receiver 440*b*. The charge cable 442*a* extends from the receptacle 444 through the charge tube 440*a* and along a periphery of the charge tube 440*a* in a spiral configuration.

The charge cable 442*a* is connected to each of the shaped charges 136 in the charge tube 440*a* for activation thereof. The ports 442*b* extend through the charge tube 440*a*. The shaped charges 136 are positioned about the ports 442*b* to fire jets therethrough upon detonation. The ports 442*b* may be alignable with openings 443 in the perforating housing 436*a* for firing therethrough upon detonation.

The charge feedthru 440*c* is positionable at an opposite end of the charge tube 440*a* from the receiver 440*b*. As shown in greater detail in FIG. 7, the feedthru 440*c* includes a locking cap (or plate) 447*a*, plunger 447*b*, retainer 447*c*, and end plate 447*d*. The end plate 447*d* is seated on the locking cap 447*a*. The plunger 447*b* is supported on the locking cap 447*a* and extends through the end plate 447*d*. The plunger 447*b* is supported on the locking cap 447*a* and extends therethrough the retainer 447*c*. Springs 449*a,b* may optionally be provided to support the plunger 447*b* in the retainer 447*c*.

As shown in FIGS. 4B and 6A, the charge tube 440*a*, receiver 440*b*, and feedthru 440*c* may have quick-locking features for lockingly connection in a desired position. In the example shown, the charge tube 440*a* is provided with guide slots 446*a,b* at each end shaped to matingly receive keys 448*a,b* positioned on the receiver 440*b* and the feed thru 440*c*.

When inserted into the end of the charge tube 440*a*, the key 448*a* of the receiver 440*b* is slidingly receivable into the guide slot 446*a*. The receiver 440*b* may be rotated so that the key 448*a* passes into the guide slot 446*a*, thereby positioning the receiver 440*b* in the desired position while also preventing unintentional retraction of the receiver 440*b* out of the charge tube 440*a*.

The charge tube 440*a* may also be provided with a locking tabs 451*a* and fastener holes 451*b* to secure the receiver 440*b* and feedthru 440*c* in position. The locking tabs 451*a* may be a cutout portion of the charge tube 440*a* corresponding to tab cavity 450*a* in the receiver 440*b* and the feedthru 440*c*. When the receiver 440*b*/the feedthru 440*c* are in position, the corresponding locking tab 451*a* may be pressed into the tab cavity 450*a* thereby further preventing movement of the receiver 440*b*/feedthru tube 440*c* about the charge tube 440*a*. Fasteners (not shown), such as pins, screws, bolts, etc., may be passed through fastener hole 451*b* and into a mated hole 450*b* in the receiver 440*b*/feedthru tube 440*c* to secure the receiver 440*b*/feedthru 440*c* to the charge tube 440*a*.

As also shown in FIGS. 4B and 6A and in FIGS. 8A-10, the receiver 440*b* is shaped to matingly receive the detonation assembly 436*b*. The detonation assembly 436*b* is insertable into the support sub 438*b* and into the end of the charge assembly 436*c*. The receptacle 444 of the receiver may be an offset (e.g., hemispherical) insert placed along an inner surface of the receiver 440*b* with features corresponding with the end of the detonation assembly 436*b*. The receptacle 444 may have, for example, a shape, surfaces, contacts, etc., for receivingly engaging the detonation assembly 436 to provide a secure fit for contact and communication therebetween as is described further herein.

Figure 10:
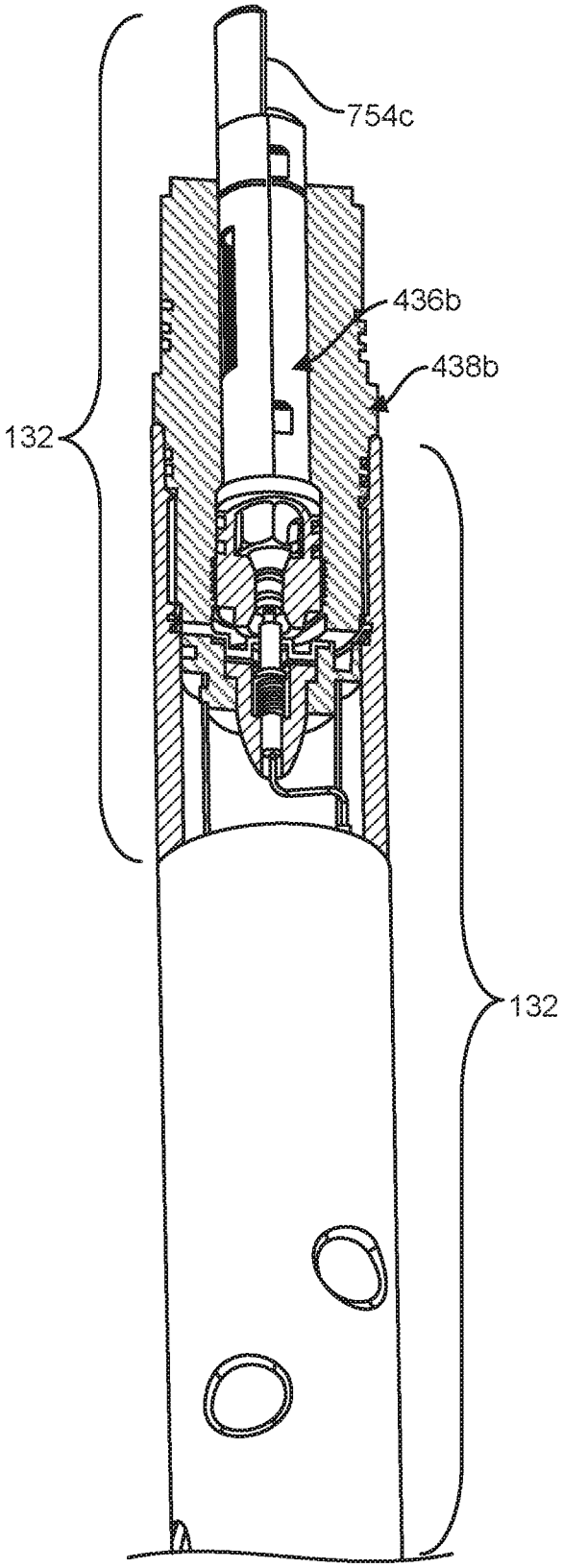
FIG. 10 is a partial cross-sectional view of a portion of the perforating unit connected to an adjacent perforating unit.
Figure 11A:
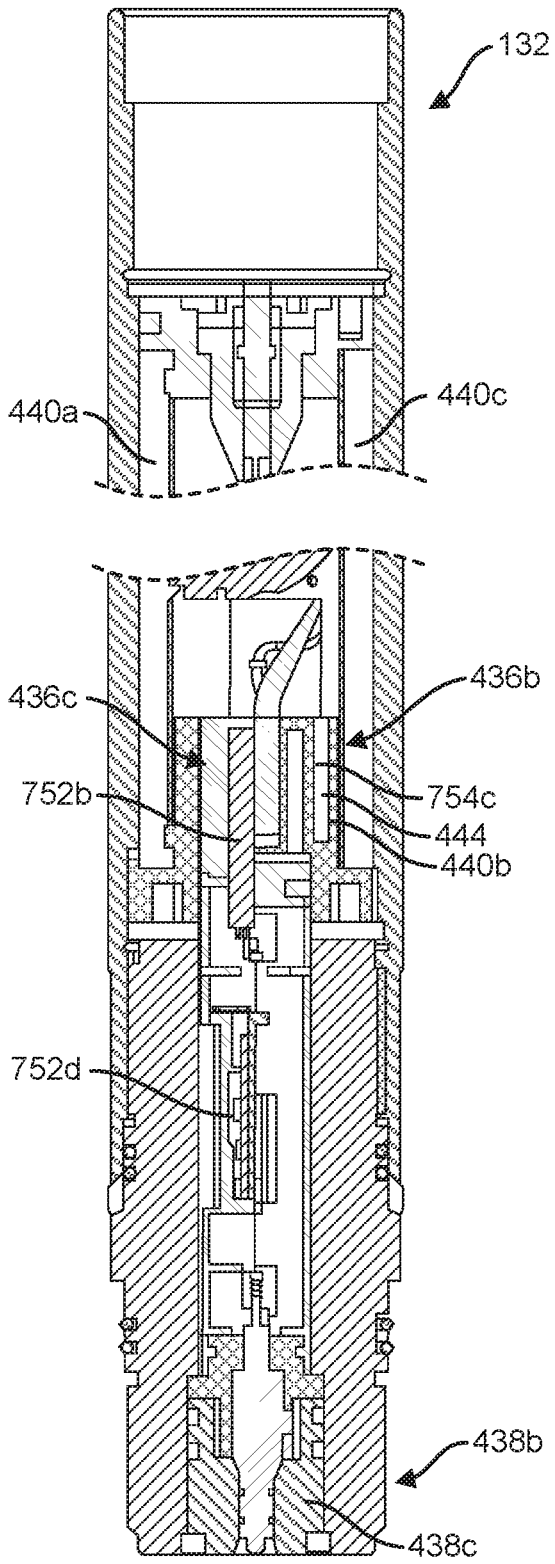
FIGS. 11A and 11B are longitudinal cross-sectional views of the detonation assembly in a seated and an unseated position, respectively, in the perforating unit.
Figure 11B:
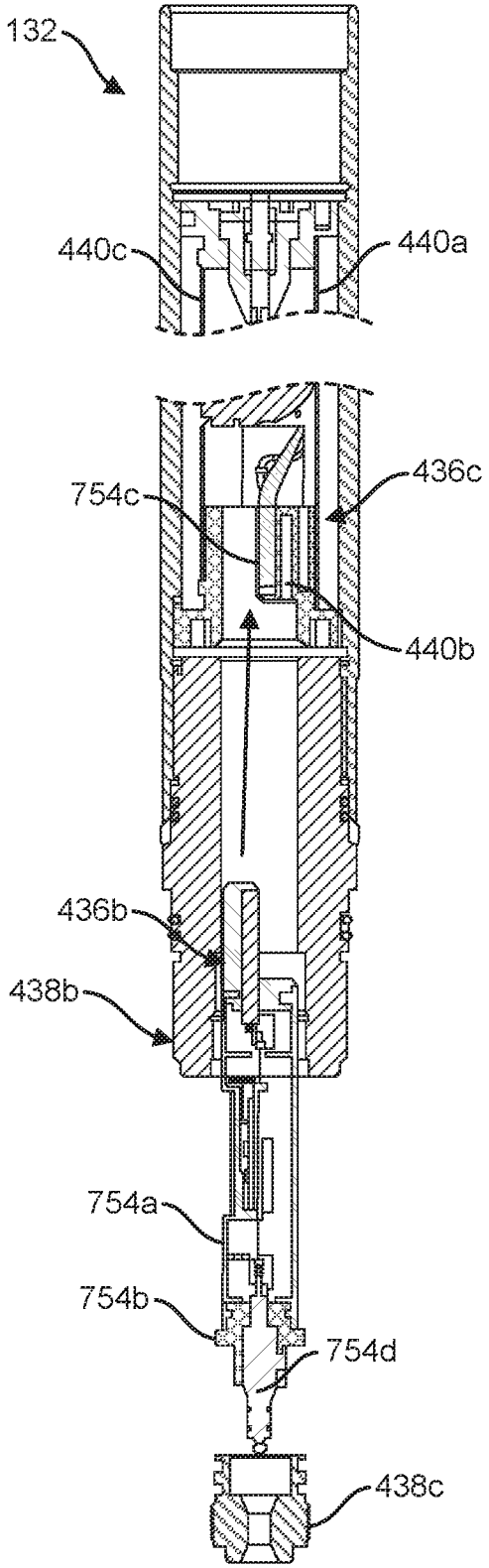
Figure 12:
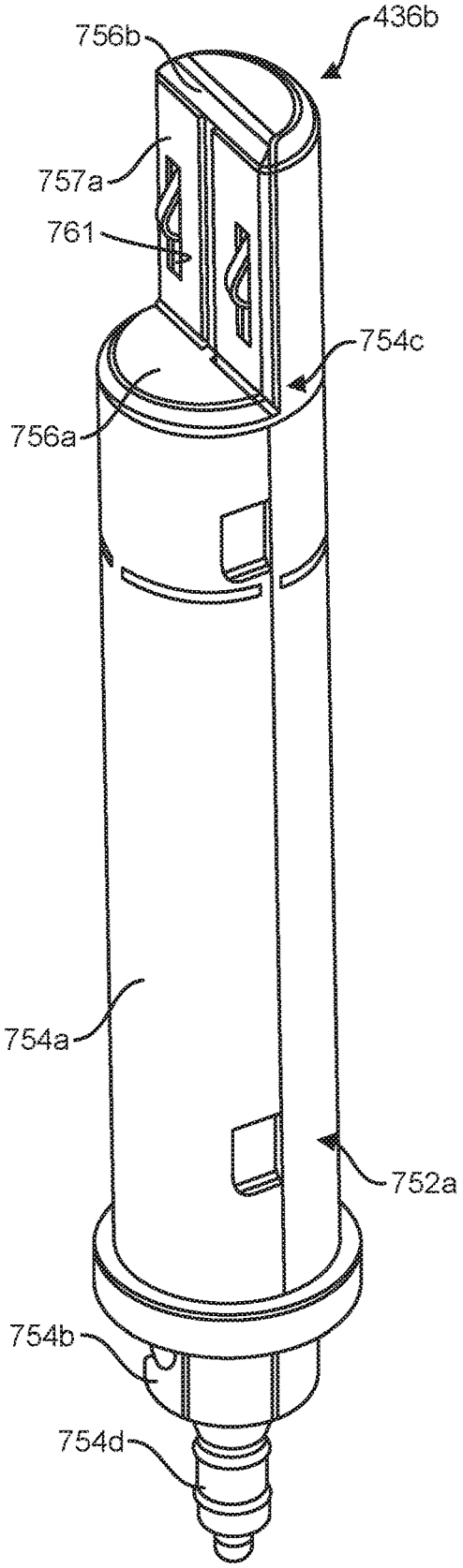
FIG. 12 is a perspective view of the detonation assembly.
Figure 13A:
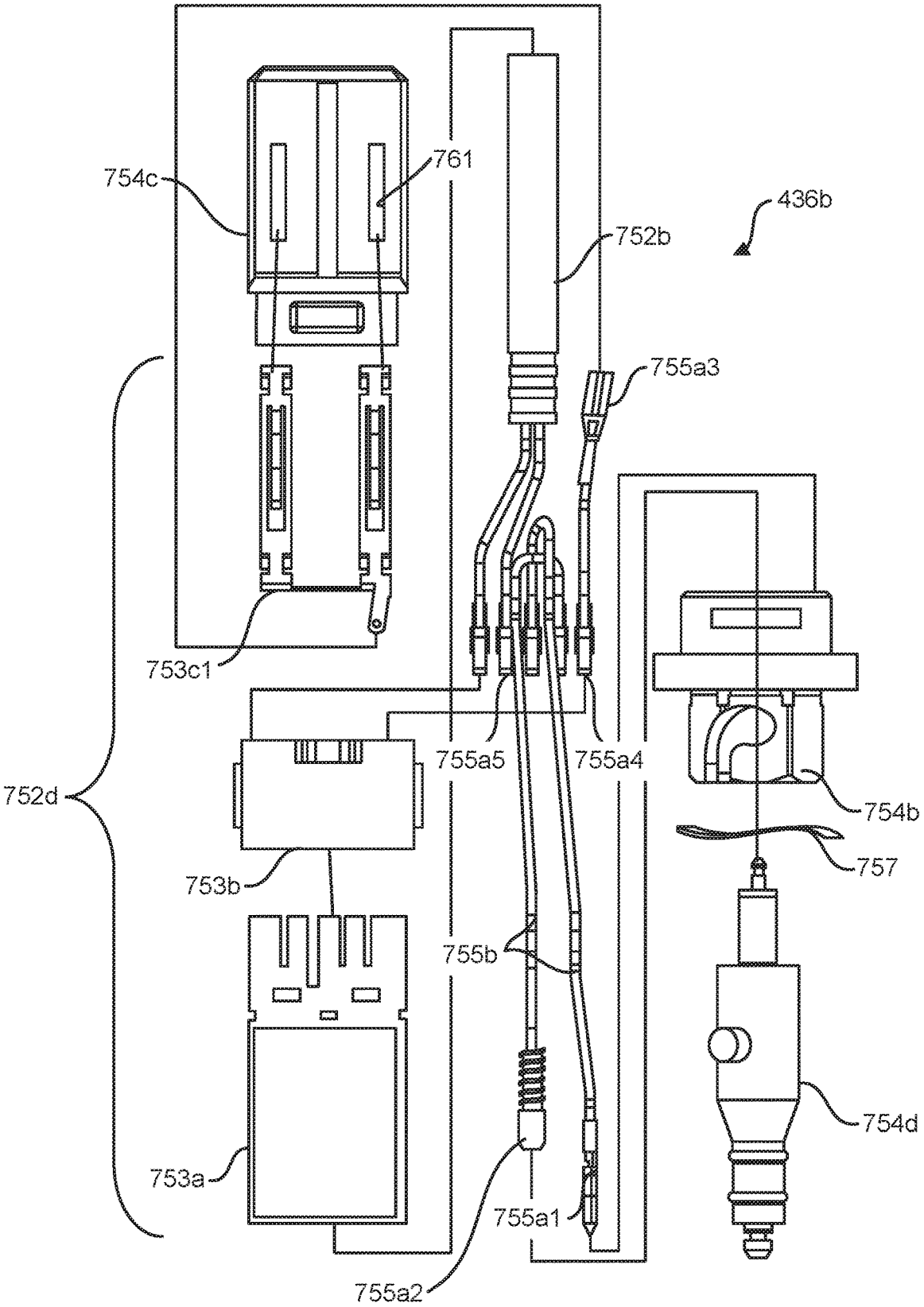
FIGS. 13A-13B are exploded views of the detonation assembly.
Figure 13B:
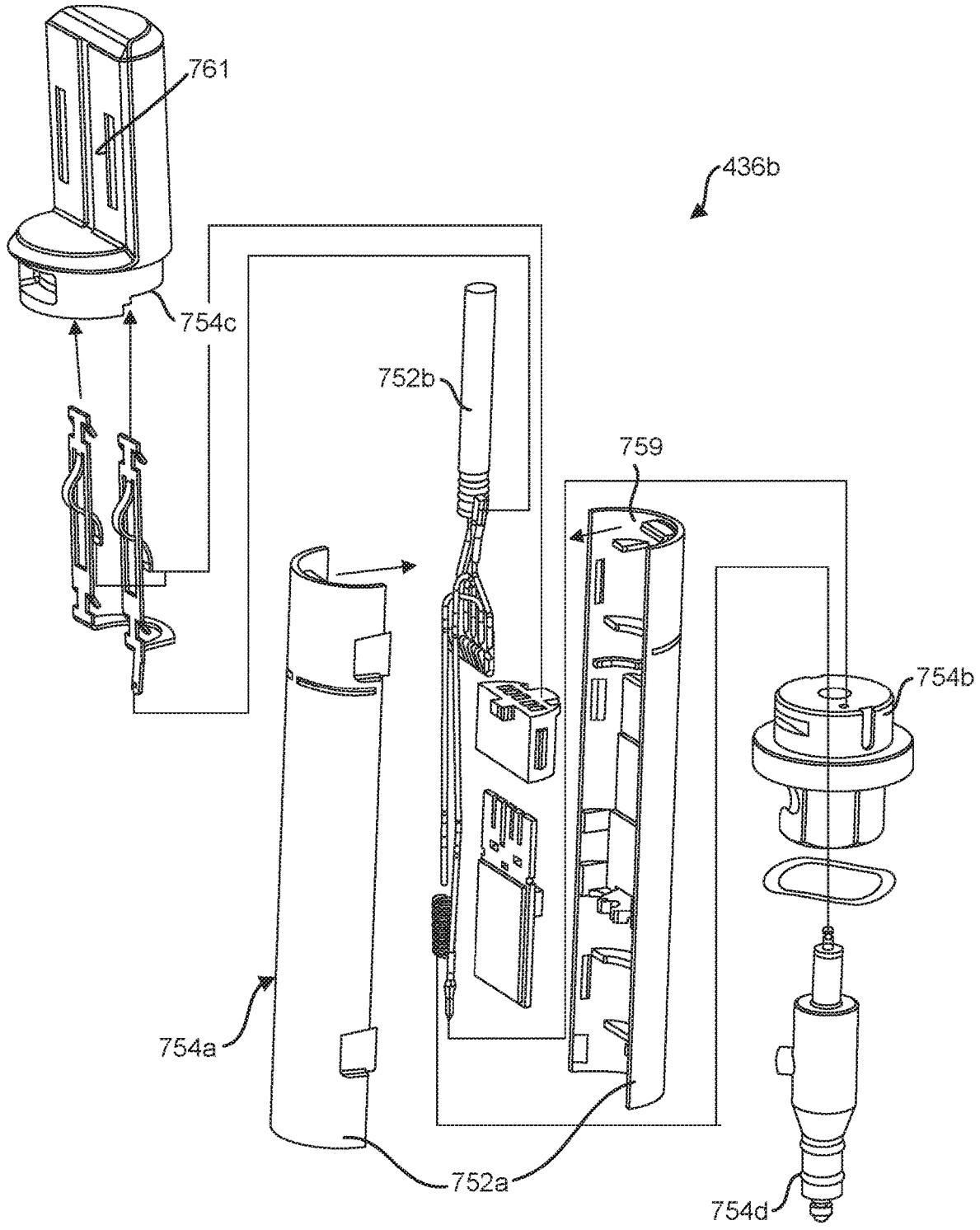

FIGS. 11A-13B show various views of the perforating unit 132 and the detonation assembly 436*b*. FIG. 10 is a partial cross-sectional view of the perforating unit 132 and the detonation assembly 436*b* therein. FIGS. 11A and 11B show cross-sectional views of the detonation assembly 436*b* in a seated and an unseated position, respectively. FIGS. 12, 13A, and 13B show the detonation assembly 436*b* outside of the perforating unit 132.

As shown in these views, the detonation assembly 436*b* includes a detonator housing 752*a*, a detonator 752*b*, and a switch assembly (or trigger) 752*c*. The detonation assembly 436*b* also includes a tube portions 754*a*, a bulkhead 754*b*, a second connector 754*c*, and a detonator feedthru 754*d*. The detonator housing 752*a* is slidably positionable in the support sub 438*b*. The detonator housing 752*a* may include one or more tube portions 754*a* connectable to form an enclosed chamber 759. The bulkhead 754*b* and the second connector 754*c* are positioned at opposite ends of the detonator housing 752*a* to close each end thereof.

The bulkhead 754*b* is positionable between the detonator housing 752*a* and the retainer 438*c*. A portion of the bulkhead 754*b* is insertable into and threadedly connected to an end of the detonator housing 752*a*. Another portion of the bulkhead 754*b* extends from the detonator housing 752*a* and is insertable into and threadedly connectable to the retainer 438*c*. The bulkhead 754*b* has a passage to receive the detonator feedthru 754*d* therethrough. The bulkhead 754*b* supports the detonator feedthru 754*d* about the end of the detonation assembly 436*b* to form a first connector for connection to the charge assembly 436*c* of an adjacent perforating unit 132.

The detonator feedthru 754*d* is connected by the switch assembly 752*c* to the detonator 752*b*. The switch assembly 752*c* includes a switch 753*a*, a plug 753*b*, and contact 753*c*1. The switch assembly 752*d* also includes connectors 755*a*1-*a*5 and cables 755*b*. The plug 753*b* is seated in the switch 753*a*. The connectors 755*a*1-*a*4 are connected to the switch plug 753*b* via cables 755*b*. The connectors 755*a*1-*a*3 are also connected to the detonator feedthru 754*d*, bulkhead 754*b*, contact 753*c*1, respectively. The connector 755*a*4 is also connected the switch plug 753*b* to the detonator 752*b*. The connectors 755*a*1-*a*4 may take various forms. In the examples shown, the connectors 755*a*1-*a*3 include a pin contact 755*a*1, a spring coupling 755*a*2, and a slotted receptacle 755*a*3 capable of mating with the components and connectable with the cables 755*b* for communication therebetween. The cables 755*b* are provided with connectors 755*a*5 for insertion into the switch plug 753*b*.

As shown in FIGS. 8A-8C, 9A-9B, and 11A-11B, the second connector 754*c* is positioned between the detonator housing 752*a* and the charge tube 440*a*. The second connector 754*c* has a cylindrical portion 756*a* positioned in an end of the detonator housing 752*a* and an insert (e.g., hemispherical) portion 756*b* extending from an end of the detonator housing 752*a*. The insert portion 756*b* extends from the detonator housing 752*a* and is positionable into the charge tube 440*a* for communicative coupling with the receptacle 444 of the receiver 440*b*.

The cylindrical portion 756*a* is shaped to close an end of the detonator housing 752*a*. The hemispherical portion 756*b* is insertable through the support sub 438*b* and into the receiver 440*b*. The hemispherical portion 756*b* is shaped to matingly engage the contact receiver positioned in the charge tube 440*a*. The hemispherical portion 756*b* is also shaped for a one way fit into the charge tube 440*a* for positive alignment therein. The hemispherical portion 756*b* is also provided with a contact surface 757*a* positionable against a corresponding contact surface 757*b* of the receptacle 444.

Figure 14:
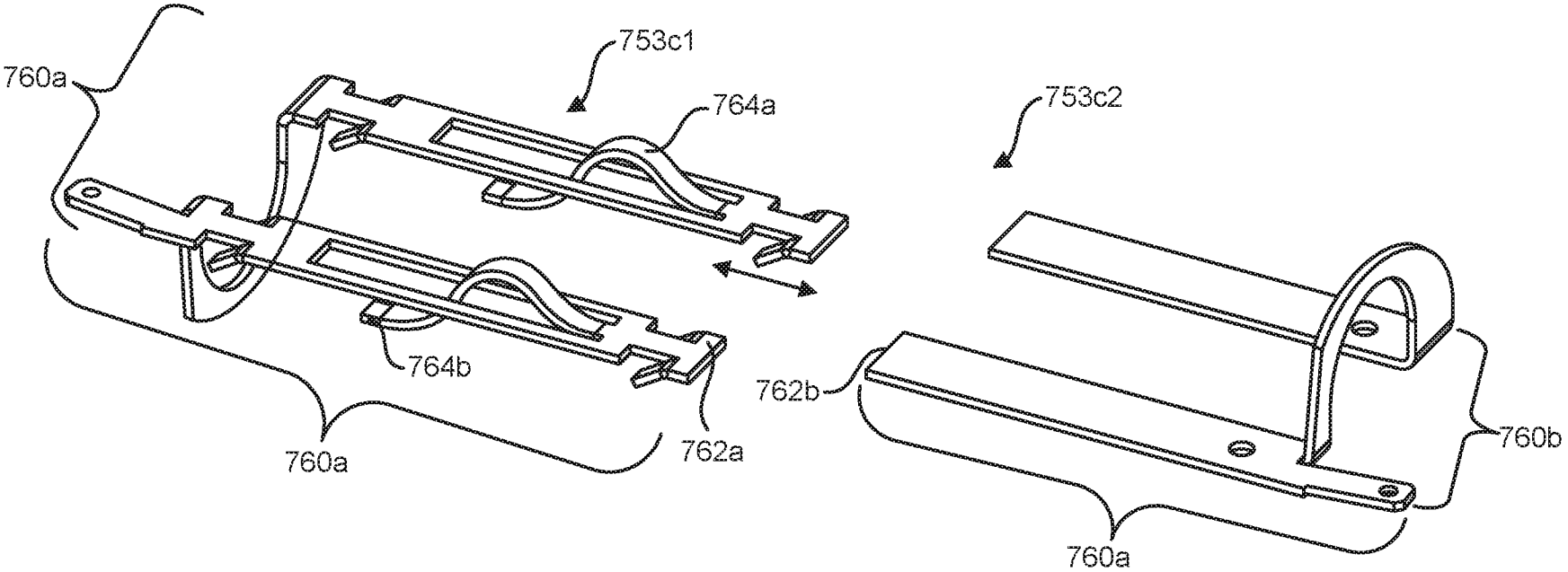
FIG. 14 is an exploded view of a detonator contact and a corresponding charge contact.

The contacts 753*c*1,*c*2 are shown in greater detail in FIG. 14. The detonation contacts 753*c*1,*c*2 may include a contact portion 760*a* and a support portion 760*b*. Both portions 760*a,b* have a curved portion shaped to receivingly engage an outer surface of the detonator 752*b*, and a flat portion extending from the curved portion. The flat portion of the portions 760*a,b* include a pair of arms 762*a,b* positionable adjacent to each other. The arms 762*b* are shown as having flat surfaces and the arms 762*a* are shown as having flat and curved portions.

Each of the arms 762*a* have elongate cutout portions that are curved about the flat portion. The cutout portions include a curved portion 764*a* and tip portions 764*b*. The curved portions 764*a* are attached at one end from the flat portion and extend therefrom to rise a distance above the flat portion. The tip portions 764*b* extend from the curved portions through an opening defined by cutout of the arms 762*a*, and to a distance below the flat portion.

The contacts 753*c*1,*c*2 may be of a conductive material (e.g., metal) compressible against the arms 762*b* of the adjacent support arms 762*b*. When the curved arms 762*a* are compressed against the arms 762*b*, the curved arms 762*a* have a spring force that extends therefrom. The curved arms 762*a* are shaped to extend through openings 761 in the second connector 764*c*.

The detonator contact 753*c*1 is connected at one end to the switch assembly 752*d* and has another end extended into the second connector 754*c*. The detonator 752*b* is supported in the housing between the switch assembly 752*d* and the second connector 754*c*. The detonator 752*b* is supported in the housing by the contact 753*c*1. The curved portion 760*b* is shaped to receive an outer surface of the detonator.

Figure 15A:
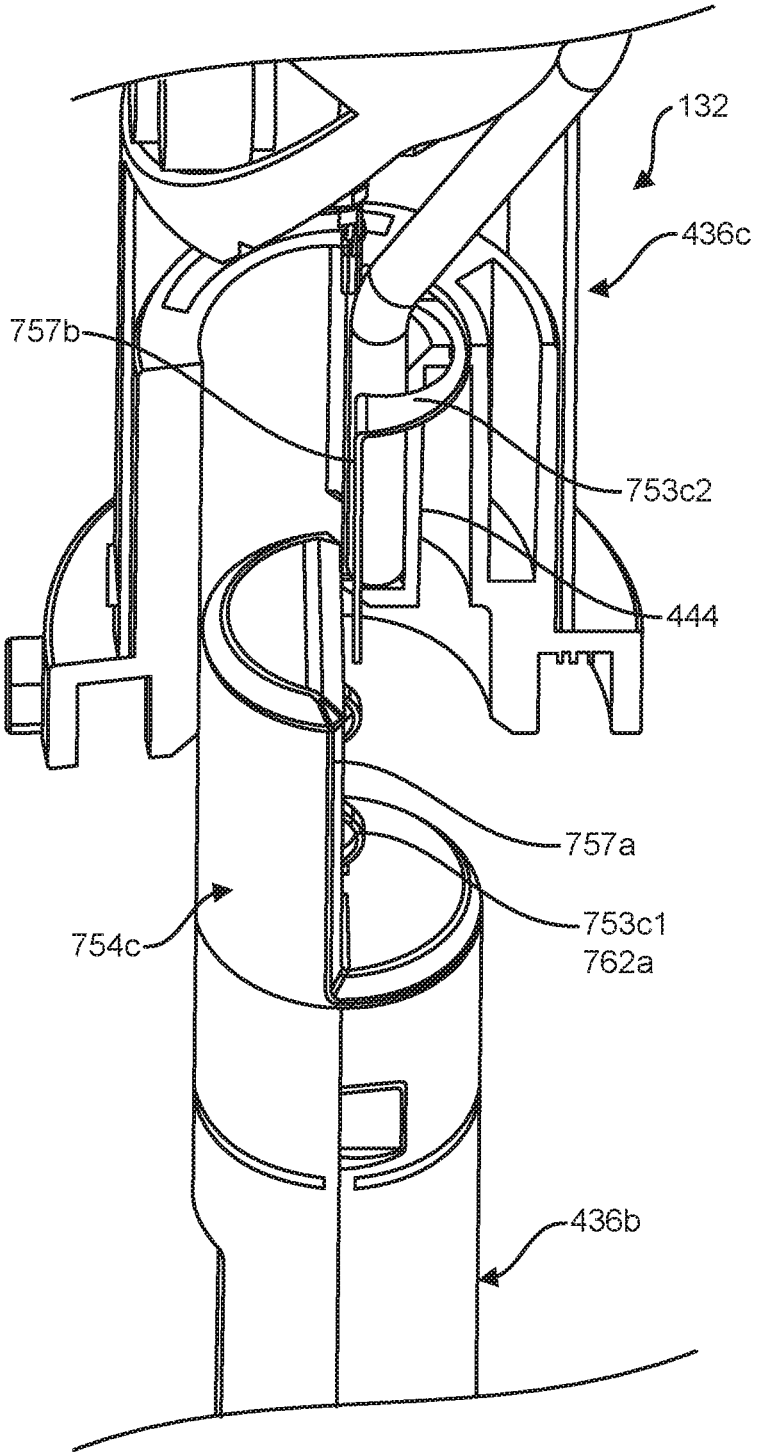
FIGS. 15A and 15B are partial cross-sectional views of the perforating unit with portions removed to show the detonator and charge contacts in a disengaged and an engaged position respectively.
Figure 15B:
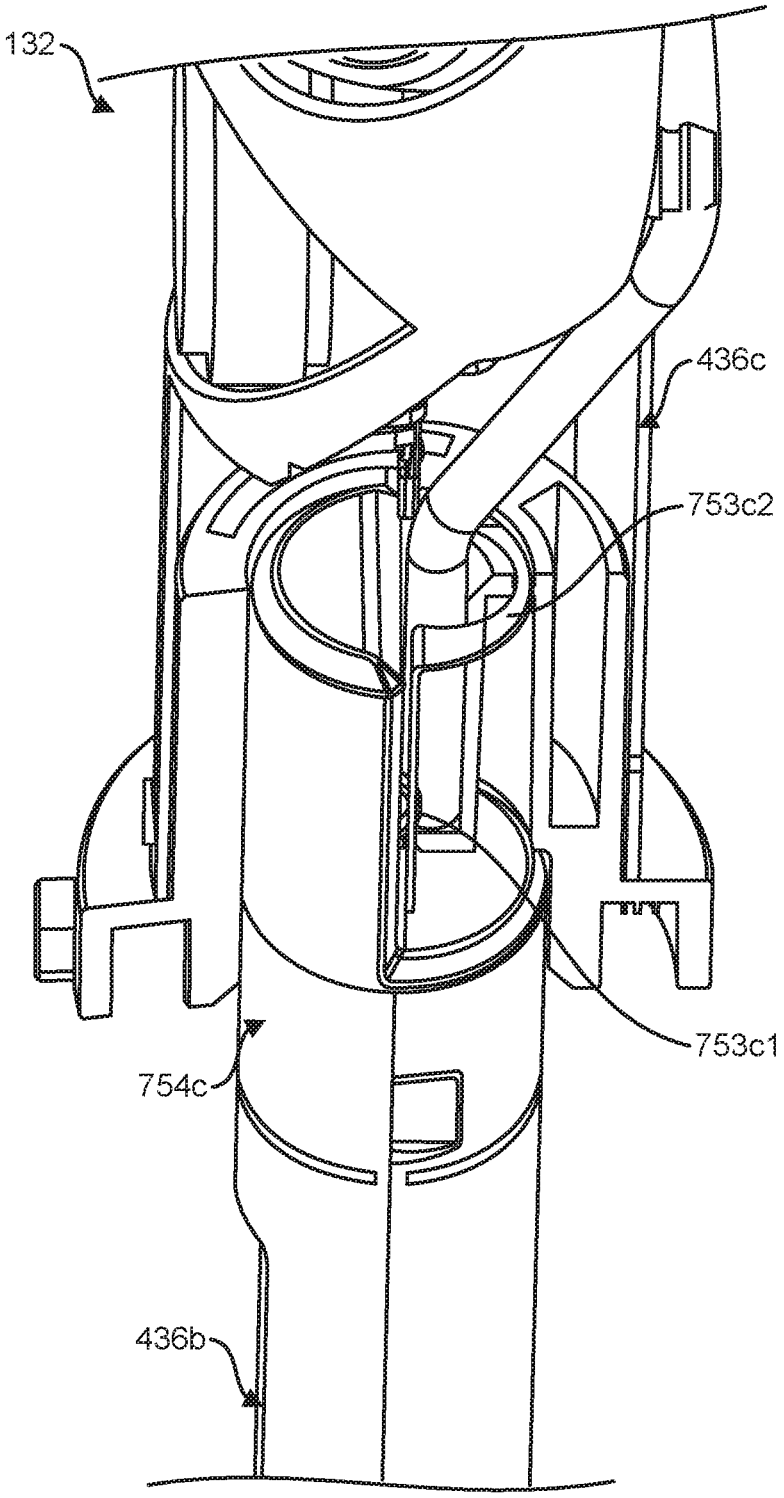

As shown in FIGS. 15A-15B (also seen in 8B-8C, 9-14B), a quick-locking connection is defined between the detonation assembly 436*b* and the charge assembly 436*c*. FIGS. 15A-15B show perforating unit 132 with the detonation assembly 436*b* before and after insertion into the charge assembly 436*c*. For descriptive purposes, portions of the perforating unit 132 have been removed so that engagement of the contacts 753*c*1, *c*2 may be seen.

When the second connector 764*c* is inserted into the receptacle 444 of the charge assembly 436*c*, the surface 757*a* of the second connector 754*c* is positioned adjacent the corresponding surface 757*b* of the receptacle 444. The curved arms 762*a* of the detonator contact 753*c*1 extends through the openings 761 for engagement with the charge receptacle 444. The spring force of the curved arms 762*a* urges the detonator contact 753*c*1 into communicative contact with the contact 753*c*2. The spring force may be defined to apply sufficient force to urge contact via the switch assembly 752*c* (FIGS. 13A-13B) to be maintained between the contacts 753*c*1 and 753*c*2.

In operation, a signal is sent from the surface unit 111 (shown in FIG. 1) via the wireline 116 and to the perforating units 132 (shown best in FIG. 3). The signal passes through each of the perforation units 132 and to the detonation assemblies 436*b* (shown in FIG. 4B). When an electric communication signal from the surface unit 111 is passed through the downhole tool 118 by communication link 441, the signal is passed to a desired perforating unit 132. The signal identifies the detonation assembly 436*b* for a particular perforating unit 132. Once identified, the switch 753*a* opens enabling power to pass to the detonator 752*b* for that perforating unit 132.

The signal passes through the detonator feedthrough 754*d* and the bulkhead 754*b*, and to the switch assembly 752*d* (shown in FIG. 13B). This signal opens the electric switch 753*a*, allowing electrical communication between a surface power supply and the detonator 752*b*. When the power at the surface applies voltage to the detonator 752*b*, the current is drawn and the detonator 752*b* causes the shaped charge to explode. The increased power supply voltage results in a current down the communication link 441. This current initiates a propellant within the shaped charge 136, which creates an expanding gas inside. This explosion activates the charge cable 442*a* which causes the shaped charges 136 in the charge tube (shown in FIG. 4B) to explode and creating the perforations 135 (shown in FIG. 1).

Figure 16:
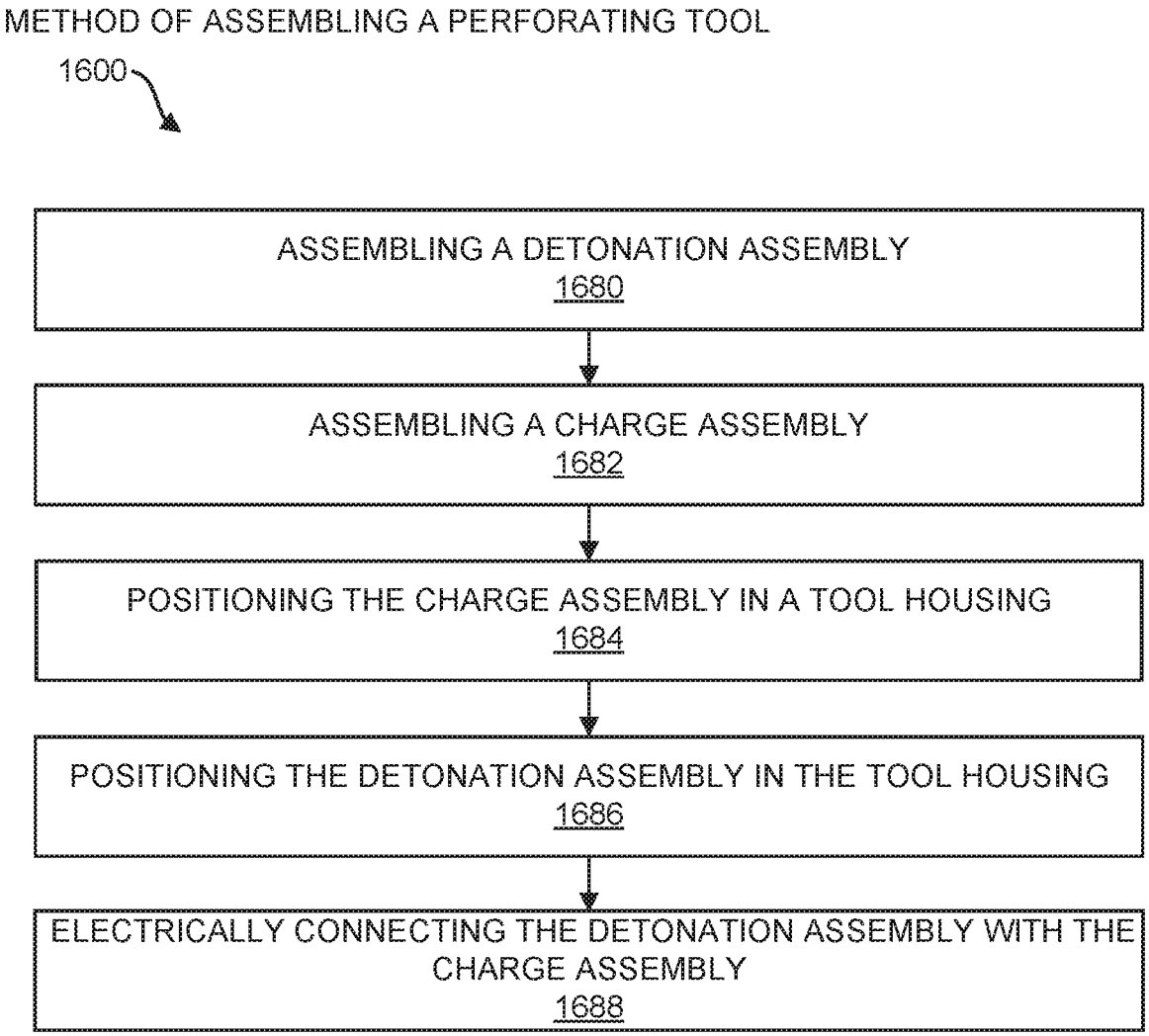
FIG. 16 is a flow chart depicting a method of assembling a perforating tool.

FIG. 16 is a flow chart depicting a method 1600 of assembling a detonation assembly and a perforating tool, such as those described herein. The method 1600 involves 1680 assembling a detonation assembly; 1682 assembling a charge assembly; 1684 positioning the charge assembly in a tool housing; 1686 positioning the detonation assembly in the tool housing; and 1688 electrically connecting the detonation assembly with the charge assembly.

Part or all of the assembly may be performed on or offsite from the wellsite. Portions of the method may be performed in various orders, and part or all may be repeated.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features and/or methods provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter. For example, while certain connectors are provided herein, it will be appreciated that various forms of connection may be provided. While the figures herein depict a specific configuration or orientation, these may vary. First and second are not intended to limit the number or order.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. A detonation assembly for a perforating unit of a downhole tool positionable in a wellbore penetrating a subterranean formation, the perforating unit also including a charge assembly, the detonation assembly comprising:

a detonator housing positionable within the perforating unit, the detonator housing having an uphole end and a downhole end;

an uphole connector and a downhole connection positioned at the uphole end and the downhole end, respectively, of the detonator housing, the downhole connection positionable adjacent the charge assembly;

a detonator positioned in the detonator housing; and a trigger positioned in the detonator housing, the trigger comprising a detonation switch and a detonator contact, the detonation switch communicatively coupled, when in use, between a remote actuator and the detonator contact, the detonator contact positionable in the downhole connection, the detonator contact having spring-loaded arms extending through openings in the downhole connection to urge electrical contact with the charge assembly whereby an electrical connection is maintained between the detonator and the charge assembly.

2. The detonation assembly of claim 1, wherein the uphole connector is connectable to a second perforating unit of the downhole tool, the uphole connector comprising a bulkhead and a feedthru, the uphole connector electrically connected to the detonation switch.

3. The detonation assembly of claim 2, wherein the bulkhead is electrically connected to the detonator switch by a spring-loaded pin.

4. The detonation assembly of claim 3, wherein the bulkhead is electrically connectable to the feedthru and the feedthru is electrically connectable to a third perforating unit of the downhole tool.

5. The detonation assembly of claim 1, wherein the downhole connection comprises an insert portion insertable into an opening of the detonator housing and an asymmetrical portion extending from the insert portion, the asymmetrical portion receivably positionable into a mated receptacle in the charge assembly.

6. The detonation assembly of claim 5, wherein the openings are positioned along a flat surface of the asymmetrical portion, the flat surface positionable against a corresponding flat surface of the mated receptacle of the charge assembly.

7. The detonation assembly of claim 1, wherein the detonator contact comprises a spring portion and a support portion, the spring and support portions each having a curved portion shaped to receive the detonator and a flat portion extending therefrom, the spring portion having the spring-loaded arms in the flat portion thereof.

8. The detonation assembly of claim 7, wherein the flat portions of each of the spring and support portions are positionable adjacent to each other, the spring-loaded arms having an engagement portion coupled to the flat portion and engageable with a flat surface of the charge assembly and a support tip extending from the engagement portion for engagement with the flat portion of the support portion whereby the engagement portion is urged against the flat surface of the charge assembly.

9. The detonation assembly of claim 1, wherein the trigger further comprises a plug and contacts electrically connectable between the detonator switch and the detonator contact.

10. The detonation assembly of claim 1, wherein the uphole connector comprises a bulkhead and a feedthru, the bulkhead having a slotted lock, the feedthru having a mated pin engageable with the slotted lock.

11. A downhole tool positionable in a wellbore penetrating a subterranean formation, the downhole tool comprising:

a tool housing positionable in the wellbore; and at least one perforating unit positionable in the tool housing, each of the at least one perforating units comprising:

a perforating housing;

a charge assembly positioned in the perforating housing, the charge assembly having a charge chamber with shaped charges releasably supported in the charge chamber; and a detonation assembly positioned in the perforating housing, the detonation assembly comprising:

a detonator housing having an uphole end and a downhole end and positionable in the perforating housing;

an uphole connector and a downhole connection positioned at the uphole end and the downhole end, respectively, of the detonator housing, the downhole connection positionable adjacent the charge assembly;

a detonator positioned in the detonator housing; and a trigger positioned in the detonator housing, the trigger comprising a detonation switch and a detonator contact, the detonation switch communicatively coupled, when in use, between a remote actuator and the detonator contact, the detonator contact positionable in the downhole connection, the detonator contact having spring-loaded arms extending through openings in the downhole connection to urge electrical contact with the charge assembly whereby an electrical connection is maintained between the detonator and the charge assembly.

12. The downhole tool of claim 11, wherein the charge assembly comprises a charge tube, a receiver, and a charge feedthru.

13. The downhole tool of claim 12, wherein the charge feedthru is electrically connectable with the detonator feedthru, the charge feedthru comprising a locking cap, plunger, retainer, and end plate.

14. The downhole tool of claim 12, wherein the detonator contact has an asymmetric end positionable in the receiver, the receiver comprising a detonation link defining a detonator receptacle in the receiver, the detonator receptacle shaped to matingly receive the asymmetric end and the detonation link having a contact surface engageable with electrical contacts.

15. The downhole tool of claim 11, further comprising a retainer.

16. The downhole tool of claim 11, further comprising a support sub.

17. The downhole tool of claim 11, further comprising a conveyance connector.

18. A method of assembling a downhole tool, the method comprising:

assembling the detonation assembly as in claim 1;

assembling the charge assembly;

providing a tool housing;

positioning the charge assembly in the tool housing;

positioning the detonation assembly in the tool housing; and electrically connecting the detonation assembly with the charge assembly.

19. The method of claim 18, further comprising positioning a second perforating unit in the tool housing and connecting the uphole connector to the second perforating unit.

20. The method of claim 19, wherein the uphole connector comprises a bulkhead and a feedthrough, the method further comprising electrically connecting the uphole connector to the detonation switch.

* * * * *